US006902162B2

(12) United States Patent
Otto et al.

(10) Patent No.: US 6,902,162 B2
(45) Date of Patent: Jun. 7, 2005

(54) NON-MARKING ACCUMULATOR AND RELATED METHODS

(75) Inventors: Edward M. Otto, Bethlehem, PA (US); John J. Semanick, Bethlehem, PA (US); James R. Moser, Easton, PA (US); Richard W. Finnochio, Saylorsburg, PA (US); Phuong T. Do, Allentown, PA (US)

(73) Assignee: Bowe Bell + Howell Company, Durham, NC (US)

( * ) Notice: Subject to any disclaimer, the term of this patent is extended or adjusted under 35 U.S.C. 154(b) by 0 days.

(21) Appl. No.: 10/174,859

(22) Filed: Jun. 19, 2002

(65) Prior Publication Data

US 2003/0151190 A1 Aug. 14, 2003

Related U.S. Application Data

(60) Provisional application No. 60/356,229, filed on Feb. 12, 2002.

(51) Int. Cl.[7] ..... B65H 31/00

(52) U.S. Cl. ..... 271/207; 271/220; 271/223; 271/241; 271/3.01; 271/3.05; 271/3.08

(58) Field of Search ..... 271/241, 207, 271/220, 3.01, 3.05, 3.08, 223

(56) References Cited

U.S. PATENT DOCUMENTS

| | | | | |
|---|---|---|---|---|
| 3,075,630 A | | 1/1963 | Fisk | |
| 4,340,213 A | * | 7/1982 | Jensen | 271/219 |
| 4,640,506 A | | 2/1987 | Luperti et al. | |
| 4,767,115 A | * | 8/1988 | Garthe | 271/223 |
| 4,805,891 A | | 2/1989 | Luperti et al. | |
| 5,131,644 A | * | 7/1992 | DuBois | 271/84 |
| 5,147,092 A | * | 9/1992 | Driscoll et al. | 271/184 |
| 5,178,379 A | * | 1/1993 | Edwards et al. | 271/189 |
| 5,244,200 A | * | 9/1993 | Manzke | 271/198 |
| 5,375,825 A | * | 12/1994 | Kennish | 270/58.02 |
| 5,435,534 A | * | 7/1995 | Linkowski et al. | 270/51 |
| 5,441,244 A | * | 8/1995 | Bartoes et al. | 270/45 |
| 5,445,368 A | * | 8/1995 | Lester et al. | 270/59 |
| 5,472,181 A | * | 12/1995 | Lowell | 270/58.09 |
| 5,484,255 A | * | 1/1996 | Lowell | 414/789 |
| 5,590,873 A | * | 1/1997 | Smart et al. | 271/303 |
| 5,647,587 A | * | 7/1997 | Smart et al. | 271/223 |
| 5,655,761 A | * | 8/1997 | Sanchez | 271/4.09 |
| 5,692,745 A | * | 12/1997 | Neifert et al. | 271/198 |
| 5,775,689 A | * | 7/1998 | Moser et al. | 271/198 |
| 5,794,931 A | * | 8/1998 | Heilman et al. | 271/303 |
| 5,887,864 A | * | 3/1999 | Stevens et al. | 270/52.07 |

(Continued)

FOREIGN PATENT DOCUMENTS

| | | |
|---|---|---|
| EP | 0 731 046 A2 | 9/1996 |
| EP | 0 814 385 A2 | 12/1997 |

*Primary Examiner*—Donald P. Walsh
*Assistant Examiner*—Matthew J. Kohner
(74) *Attorney, Agent, or Firm*—McDermott Will & Emery LLP

(57) ABSTRACT

A sheet accumulating apparatus accumulates inputted sheets into a stack registered on all sides, wherein the sheets are controlled with minimum contact by components of the apparatus to minimize or eliminate smudging or marking of the sheets. The apparatus can be selectively adjusted to effect over-accumulation or under-accumulation, and can be adjusted to accommodate different sheet sizes. The apparatus comprises an accumulation section defining a sheet feed plane therethrough. An upper ramp is disposed upstream from the accumulation section and is movable into and out of the sheet feed plane. An upper retaining member is linked to the upper ramp and is movable into and out of the sheet feed plane in alternating relation to the upper ramp. A lower ramp is disposed below the upper ramp and is movable into and out of the sheet feed plane in alternating relation to the upper ramp. A lower retaining member is linked to the lower ramp and movable into and out of the sheet feed plane in alternating relation to the upper ramp.

24 Claims, 16 Drawing Sheets

U.S. PATENT DOCUMENTS 5,915,686 A * 6/1999 Neifert et al. ..... 271/198
5,954,330 A 9/1999 Rabindran et al.
6,010,123 A * 1/2000 Stevens et al. ..... 270/52.08
6,032,953 A * 3/2000 Otto et al. ..... 271/303
6,203,006 B1 * 3/2001 Semanick et al. ..... 271/213
6,386,537 B1 * 5/2002 Howard et al. ..... 271/303
6,575,457 B2 * 6/2003 Bakoledis ..... 271/223
6,592,114 B2 * 7/2003 Stevens et al. ..... 270/58.07
6,644,657 B2 * 11/2003 Wright et al. ..... 271/242

* cited by examiner

NON-MARKING ACCUMULATOR AND RELATED METHODS

RELATED APPLICATIONS

This application claims the benefit of U.S. Provisional Patent Application Serial No. 60/356,229, filed Feb. 12, 2002; the disclosure of which is incorporated herein by reference in its entirety.

TECHNICAL FIELD

The present invention is generally directed to the field of document handling and processing technology and, in particular, to improvements relating to the accumulation of material units.

BACKGROUND ART

A recurring problem in document handling operations is toner smudging or marking, which most often occurs as the result of the necessary interaction between document handling components and material units containing printed matter being handled by those components. The problem of toner smudging is especially acute and pervasive in document accumulation operations. In conventional accumulation configurations, a single-level accumulator drives material into and over entrance ramps with the use of o-rings (also known as polycords) that are continuously moving in the direction of material flow. These continuously moving o-rings contact each face (i.e., the front and/or the back side) of the material. The material is first driven, as separate pieces or a pair, into the accumulator from an upstream device. The material is then advanced to the exit end of the accumulator by the o-rings that are essentially designed to act as a slip drive and comes to rest as the lead edge of the material contacts a pair of output rollers. Subsequent pages then accumulate over or under each preceding piece until the accumulator's maximum capacity is reached (usually 10–15 sheets) or a full set is satisfied. The o-rings, however, continue to cycle as material comes to rest and as succeeding material enters the accumulator and begins to accumulate. Accordingly, toner smudge occurs as, for example, the bottom set of o-rings becomes impregnated with toner from preceding pieces and transfers this toner to the first page of the set as it rests in the static condition.

Examples of document handling devices such as accumulators that employ pressure-applying belts or o-rings to drive sheets are disclosed in U.S. Pat. Nos. 6,203,006; 5,915,686; 5,794,931; 5,775,689; 5,692,745; 5,655,761; 5,647,587; 5,590,873; 5,484,255; 5,244,200; 5,147,092; and 4,767,115.

Material removal can also be problematic in conventional accumulator devices. Material must be folded and often torn to be removed from between the fixed o-rings of the accumulator. Another problem relates to the stretching of o-rings over time due to wear and material removal. Moreover, material justification can be problematic, particularly when accumulating before a folder. To achieve a high quality fold with minimal shingling, a set of material that is square on all edges (front, back, and both sides) optimizes the fold quality. Other recurring issues include the ease with which an accumulator device can be changed from over-accumulation to under-accumulation, and can be adjusted to accommodate different material sizes, if such switching capabilities are provided at all.

The present invention is provided to address, in whole or in part, these and other problems associated with prior art document handling technology.

DISCLOSURE OF THE INVENTION

The invention disclosed herein provides a sheet accumulating apparatus and method for accumulating sheets. A series of single sheets, or a series of accumulated or stacked subsets of sheets, are inputted into an accumulation section. The apparatus is operable in either an over-accumulation mode or an under-accumulation mode. In the over-accumulation mode, each new sheet of subset of sheets enters the accumulation section on top of the developing stack of sheets in the accumulation section. In the under-accumulation mode, each new sheet of subset of sheets enters the accumulation section underneath the developing stack of sheets in the accumulation section. In either mode, the apparatus is constructed and its components selected and arranged so as to minimize contact or engagement between sheets and physical structure, and to enhance the control of the apparatus over the speed and flow of the sheets through the apparatus. Therefore, smudging of printed matter on the sheets and damage to the sheets are minimized. Moreover, the apparatus facilitates rapid adjustment by the user between the over-accumulation and under-accumulation modes without the need for tools. In addition, the sheets accumulating in the accumulation section are registered on all four sides, i.e., lead edge, trail edge, and lateral edges. Consequently, a predetermined number of sheets are accumulated into a fully registered stack for advancement to a location downstream of the apparatus.

According to one embodiment, a sheet accumulating apparatus comprises an accumulation section defining a sheet feed plane therethrough. An upper ramp is disposed upstream from the accumulation section and is movable into and out of the sheet feed plane. An upper retaining member is linked to the upper ramp and is movable into and out of the sheet feed plane in alternating relation to the upper ramp. A lower ramp is disposed below the upper ramp and is movable into and out of the sheet feed plane in alternating relation to the upper ramp. A lower retaining member is linked to the lower ramp and movable into and out of the sheet feed plane in alternating relation to the upper ramp.

Preferably, the upper ramp, the upper retaining member, the lower ramp, and the lower retaining member are pivotably movable into and out of the sheet feed plane, the upper ramp is pivotable in an opposite direction in relation to the pivoting of the upper retaining member, and the lower ramp is pivotable in an opposite direction in relation to the pivoting of the lower retaining member.

Preferably, the mechanical interface or functional couplings among the corresponding ramps and retaining members are implemented with linkages. Accordingly, in one embodiment, an upper linkage links the upper ramp to the upper retaining member and a lower linkage links the lower ramp to the lower retaining member. The upper linkage comprises a first upper linkage member pivotable with the upper ramp and a second upper linkage member pivotable with the upper retaining member in engagement with the first upper linkage member. The lower linkage comprises a first lower linkage member pivotable with the lower ramp and a second lower linkage member pivotable with the lower retaining member in engagement with the first lower linkage member. Even more preferably, the linkage members include respective toothed portions that engage each other, such that the linkage members can comprise intermeshing gears or gear segments.

In some embodiments, a front stop mechanism is disposed downstream from the upper and lower ramps and is movable into and out of the sheet feed plane.

In some embodiments, a carriage assembly is movably engaged with a frame of the accumulating apparatus and supports the front stop mechanism. Accordingly, the front stop mechanism is movable with the carriage assembly toward and away from the upper and lower ramps, thereby enabling the accumulating apparatus to accommodate different lengths of sheets.

Preferably, the accumulating apparatus comprises a sheet transport device. The sheet transport device comprises one or more sheet-engaging members, such as pusher fingers or lugs, that are movable through the accumulation section along the sheet feed plane. Such a sheet transport device is employed to at least begin transport of a stack of over- or under-accumulated sheets out from the accumulating section of the apparatus. The sheet-engaging members contact only the trail edge of the sheet stack and thus do not cause smudging. Hence, even with the use of the sheet transport device, sheets are still not subject to any moving components while accumulation is occurring.

Preferably, the accumulating apparatus comprises left and right side jogging members disposed at respective lateral sides of the accumulation section. These side jogging members are movable toward and away from each other along a direction transverse to a sheet flow path through the accumulation section. Alternating actuation or other movement of the side jogging members jogs the sheets into side-by-side registration in the accumulation section.

According to another embodiment, a sheet accumulating apparatus comprises an accumulation section defining a sheet feed plane therethrough, and an accumulating assembly disposed upstream from the accumulation section. The accumulating assembly is selectively adjustable to an over-accumulation position and an alternative under-accumulation position. The accumulating assembly comprises a first ramp, a first retaining member, and a first linkage interconnecting the first ramp and the first retaining member, wherein the first ramp is movable with first retaining member. The accumulating assembly also comprises a second ramp, a second retaining member, and a second linkage interconnecting the second ramp and the second retaining member, wherein the second ramp is movable with the second retaining member. At the over-accumulation position, the first ramp and the second retaining member are disposed out of the sheet feed plane, and the second ramp and the first retaining member extend in the sheet feed plane. At the alternative under-accumulation position, the first ramp and the second retaining member extend in the sheet feed plane, and the second ramp and the first retaining member are disposed out of the sheet feed plane. The sheet accumulating apparatus is thus structured so as to be adjustable to either accumulation position, and consequently is capable of either over-accumulating or under-accumulating sheets as desired by the end user.

According to yet another embodiment, a sheet accumulating apparatus comprises upper and lower frame sections, first and second upper rotatable members, upper and lower accumulation ramps, upper and lower sheet guide members, and first and second lower rotatable members. The upper frame section has an upper input end and the lower frame section has a lower input end, such that the upper and lower input ends define an input area and a sheet feed plane therebetween and the sheet feed plane extends through the input area. The first upper rotatable member is disposed in the upper frame section and the second upper rotatable member engages the first upper rotatable member, such that rotation of the first upper rotatable member in one direction corresponds to rotation of the second upper rotatable member in an opposite direction. The upper accumulation ramp is connected to the first upper rotatable member and is rotatable therewith into and out of the sheet feed plane. The upper sheet guide member is connected to the second upper rotatable member and is rotatable therewith into and out of the sheet feed plane. The first lower rotatable member is disposed in the lower frame section and the second lower rotatable member engages the first lower rotatable member, such that rotation of the first lower rotatable member in one direction corresponds to rotation of the second lower rotatable member in an opposite direction. The lower accumulation ramp is connected to the first lower rotatable member and is rotatable therewith into and out of the sheet feed plane. The lower sheet guide member is connected to the second lower rotatable member and is rotatable therewith into and out of the sheet feed plane.

According to still another embodiment, a sheet accumulating apparatus comprises upper and lower frame sections, a plurality of elongate upper and lower sheet guides, and upper and lower accumulation ramps. The upper frame section has an upper end and the lower frame section has a lower end, such that the upper and lower frame sections define an accumulation area therebetween. The upper end pivotably engages the lower end to enable the upper section to pivot away from the lower section and thus to provide access to the accumulation area. The elongate upper sheet guides are supported by the upper frame section and are pivotable therewith, and define an upper boundary of the accumulation area. The elongate lower sheet guides are supported by the lower frame section and define a lower boundary of the accumulation area. The upper accumulation ramp is supported by the upper frame section and is pivotable therewith. The lower accumulation ramp is supported by the lower frame section.

According to a further embodiment, a material accumulating apparatus comprises a frame assembly, an input section, a carriage assembly, and a front stop mechanism. The frame assembly comprises first and second lateral support plates. The input section is disposed at an upstream region of the frame assembly and defines a material flow path running between the first and second lateral support plates. The carriage assembly comprises a front stop support plate extending between the first and second lateral support plates, a first carriage member movably connecting the front stop support plate to the first lateral support plate, and a second carriage member movably connecting the front stop support plate to the second lateral support plate. The front stop mechanism is disposed downstream from the input section and is mounted to the front stop support plate. Translation of the front stop support plate along a general direction of the material flow path varies a distance between the front stop mechanism and the input section.

Preferably, the front stop mechanism comprises a front stop member and an actuator connected to the front stop member, and the front stop member is movable by the actuator into and out of the material flow path. It is also preferable that the front stop member be spring-mounted so as to provide a recoiling action upon contact with an incoming sheet and thus assist in registering sheets from lead edge to trail edge. It is further preferred that the accumulating apparatus comprise a first rack gear mounted to the first lateral support plate, a second rack gear mounted to the second lateral support plate, a first pinion gear fixedly disposed in relation to the first carriage member and engaging the first rack gear, and a second pinion gear fixedly disposed in relation to the second carriage member and engaging the second rack gear. By this configuration, rotation of the first and second pinion gears respectively along the first and second rack gears causes translation of the first and second carriage members respectively along the first and second rack gears.

In some embodiments, the invention comprises upper and lower output rollers fixedly mounted in relation to the front stop mechanism and translatable therewith.

According to a yet further embodiment, a material accumulating apparatus comprises a sheet input device, an accumulation area disposed generally downstream from the sheet input device, a front stop mechanism disposed downstream from the sheet input device, first and second output rollers disposed at a fixed distance downstream from the front stop mechanism, and a material transport device. The sheet input device comprises a first input roller and a second input roller. A material feed plane is defined between the first and second input rollers. The accumulation area comprises a plurality of upper guide rods and a plurality of lower guide rods, such that the material feed plane is disposed between the upper and lower guide rods. The front stop mechanism comprises a front stop member and an actuator connected to the front stop member. The front stop member is movable by the actuator into and out of the material feed plane. The material transport device comprises movable material-engaging lugs between the first and second input rollers and the first and second output rollers.

According to a still further embodiment, a material accumulating apparatus comprises a frame assembly, an input section disposed at an upstream region of the frame assembly, a side jogging mechanism disposed downstream from the input section, and a front stop mechanism disposed downstream from the input section. The frame assembly comprises first and second lateral support plates. The input section defines a material flow path running between the first and second lateral support plates. The side jogging mechanism comprises an upstream support rod extending between the first and second lateral support plates, a downstream support rod extending between the first and second lateral support plates, first and second mounting brackets, first and second side guides respectively linked to the first and second mounting brackets, and first and second actuating devices. Each mounting bracket has an upstream end slidably supported by the upstream support rod and a downstream end slidably supported by the downstream support rod. The first and second actuating devices are respectively adapted to translate the first and second side guides along a direction transverse to the material flow path. The front stop mechanism is mounted to the front stop support plate. Translation of the front stop support plate along a general direction of the material flow path varies a distance between the front stop mechanism and the input section.

According to other embodiments, the accumulating section comprises a plurality of upper elongate members and a plurality of lower elongate members. The sheet feed plane is defined between the upper and lower elongate members. Preferably, the upper and lower elongate members are cylindrical in cross-section so as to provide the minimum possible contact area for sheets that encounter the elongate members.

A method is also provided for registering one or more sheets during or after accumulation of the sheets in an accumulating apparatus, according to the following steps. An accumulation section is provided that defines a sheet feed plane. A front stop is moved into the sheet feed plane. A back stop is moved into the sheet feed plane at a position upstream from the front stop. A sheet is moved along an input path past the back stop into the accumulation section, whereby the sheet contacts the front stop and is recoiled thereby toward the back stop. The sheet is alternately translated along opposing directions transverse to the input path. Preferably, the sheet is moved past the back stop by contacting the sheet with an inclined surface of the back stop, whereby the sheet is at least temporarily diverted away from the sheet feed plane to move around the back stop. The sheet is alternately translated preferably by alternately moving left and right opposing side guides toward and away from a centerline of the accumulation section.

A method is also provided for adjusting an accumulating apparatus between an over-accumulating mode and an under-accumulating mode, according to the following steps. An accumulating section is provided that defines a sheet feed plane extending therethrough. An accumulating assembly is generally disposed upstream from the accumulating section and comprises an upper ramp, an upper retaining member movably linked to the upper ramp, a lower ramp, and a lower retaining member movably linked to the lower ramp. An over-accumulating mode is set by causing the upper ramp to move out of the sheet feed plane whereby the upper retaining member moves into the sheet feed plane, and causing the lower ramp to move into the sheet feed plane whereby the lower retaining member moves out of the sheet feed plane. The under-accumulating mode is an alternative setting. The under-accumulating mode is set by causing the upper ramp to move into the sheet feed plane whereby the upper retaining member moves out of the sheet feed plane, and causing the lower ramp to move out of the sheet feed plane whereby the lower retaining member moves into the sheet feed plane.

According to another method, sheets are over-accumulated according to the following steps. An accumulating section is provided that defines a sheet feed plane extending therethrough. An accumulating assembly is generally disposed upstream from the accumulating section and comprises an upper retaining member and a lower ramp, wherein the upper retaining member and the lower ramp extend into the sheet feed plane. An incoming sheet is moved generally along the sheet feed plane toward the lower ramp. The incoming sheet is caused to contact the lower ramp and move over the lower ramp. The incoming sheet is caused to contact the upper retaining member and be guided downwardly thereby, whereby the incoming sheet enters the accumulating section between the upper retaining member and a preceding sheet residing in the accumulating section.

According to yet another method, sheets are under-accumulated according to the following steps. An accumulating section is provided that defines a sheet feed plane extending therethrough. An accumulating assembly is generally disposed upstream from the accumulating section and comprises an upper ramp and a lower retaining member, wherein the upper ramp and the lower retaining member extend into the sheet feed plane. An incoming sheet is moved generally along the sheet feed plane toward the upper ramp. The incoming sheet is caused to contact the upper ramp and move below the upper ramp. The incoming sheet is caused to contact the lower retaining member and be guided upwardly thereby, whereby the incoming sheet enters the accumulating section between the lower retaining member and a preceding sheet residing in the accumulating section.

According to a further method, sheets are over-accumulated according to the following steps. A first sheet is inputted along a sheet feed plane toward an accumulation area. The first sheet is diverted above the sheet feed plane.

The first sheet is urged downwardly as the first sheet moves into the accumulation area, and comes to rest in the accumulation area. A second sheet is inputted along the sheet feed plane toward the accumulation area. The second sheet is diverted above the sheet feed plane. The second sheet is urged downwardly as the second sheet moves into the accumulation area, and comes to rest in the accumulation area on top of the first sheet. The method can be repeated for subsequent sheets to form an accumulated stack of sheets in the accumulation area.

According to an additional method, sheets are under-accumulated according to the following steps. A first sheet is inputted along a sheet feed plane toward an accumulation area. The first sheet is diverted below the sheet feed plane. A trailing edge of the first sheet is urged upwardly as the first sheet moves into the accumulation area, such that the first sheet comes to rest in the accumulation area with its trailing edge elevated above the sheet feed plane. A second sheet is inputted along the sheet feed plane toward the accumulation area. The second sheet is diverted below the sheet feed plane and below the trailing edge of the first sheet. A trailing edge of the second sheet is urged upwardly as the second sheet moves into the accumulation area. The second sheet comes to rest in the accumulation area underneath the first sheet, and the trailing edge of the second sheet is elevated above the sheet feed plane. The method can be repeated for subsequent sheets to form an accumulated stack of sheets in the accumulation area.

It is therefore an object to provide an accumulating apparatus for collecting and advancing sheet articles, and particularly such an apparatus for use in high-speed media processing.

It is another object to provide an accumulating apparatus that permits selection and adjustment of either over-accumulating or under-accumulating of the sheet articles processed thereby, and can also accommodate different sheet sizes.

It is yet another object to provide an accumulating apparatus for improved handling of processed sheet articles that eliminates or at least greatly minimizes toner smudging of smearing of the sheet articles.

It is still another object to provide an accumulating apparatus for improved handling of processed sheet articles wherein the sheet articles are accumulated into a fully registered set of sheets.

Some of the objects having been stated hereinabove and which are achieved in whole or in part by this invention, other objects will become evident as the description proceeds when taken in connection with the accompanying drawings as best described hereinbelow.

DETAILED DESCRIPTION OF THE INVENTION

Figure 1:
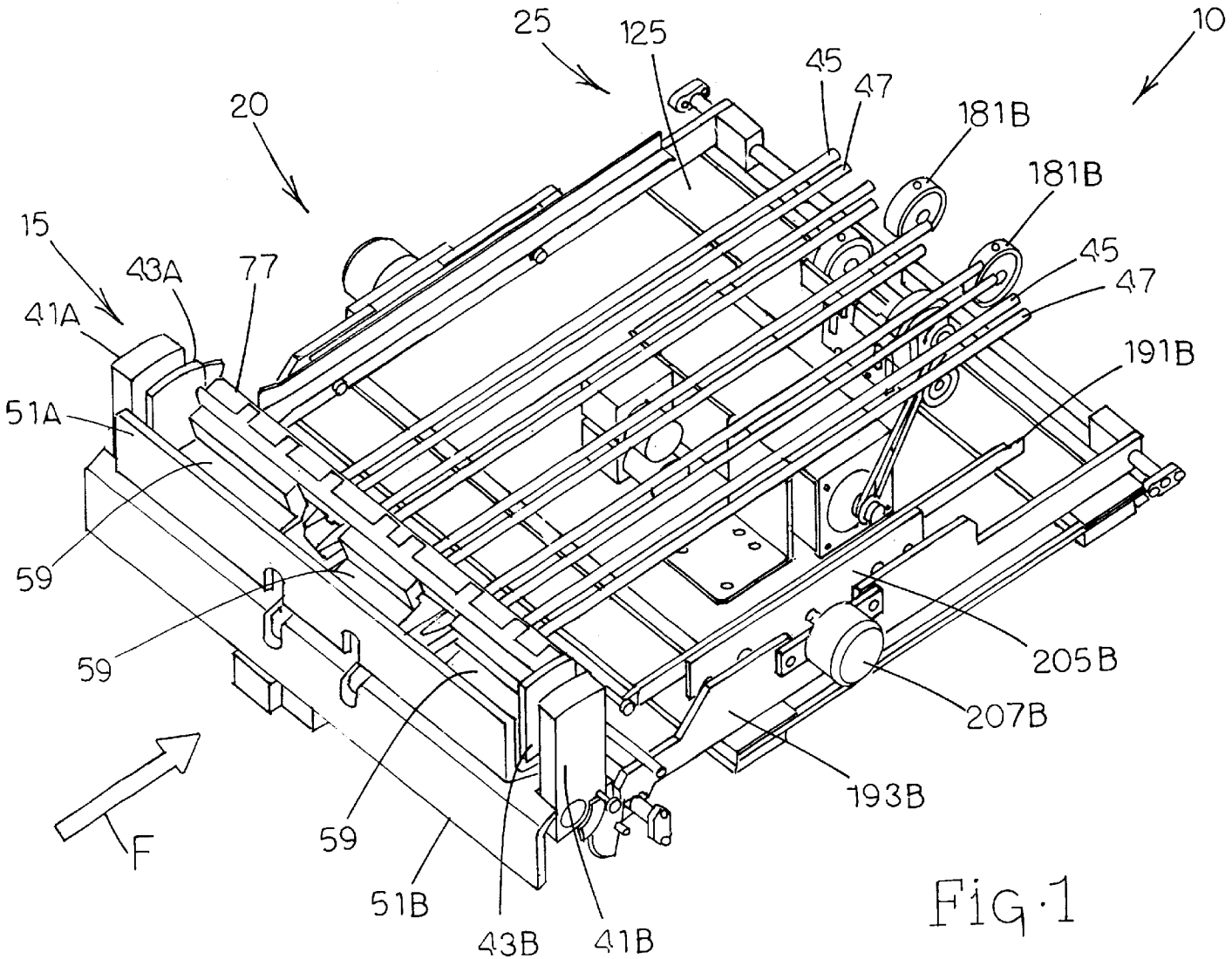
FIG. 1 is a perspective view of an accumulating apparatus provided in accordance with the present invention.

Referring now to FIG. 1, an accumulating apparatus, generally designated 10, is provided which is adapted to accumulate material without smudging or otherwise marring any printed matter contained on either side of the sheet material being processed. Accumulating apparatus 10 is also adapted to produce an accumulated set of sheets that are properly registered on all (leading, trailing, and lateral) edges. Moreover, accumulating apparatus 10 is selectively adjustable between an over-accumulating mode of operation and an under-accumulating mode of operation. These operational modes are described in detail hereinbelow.

Figure 16:
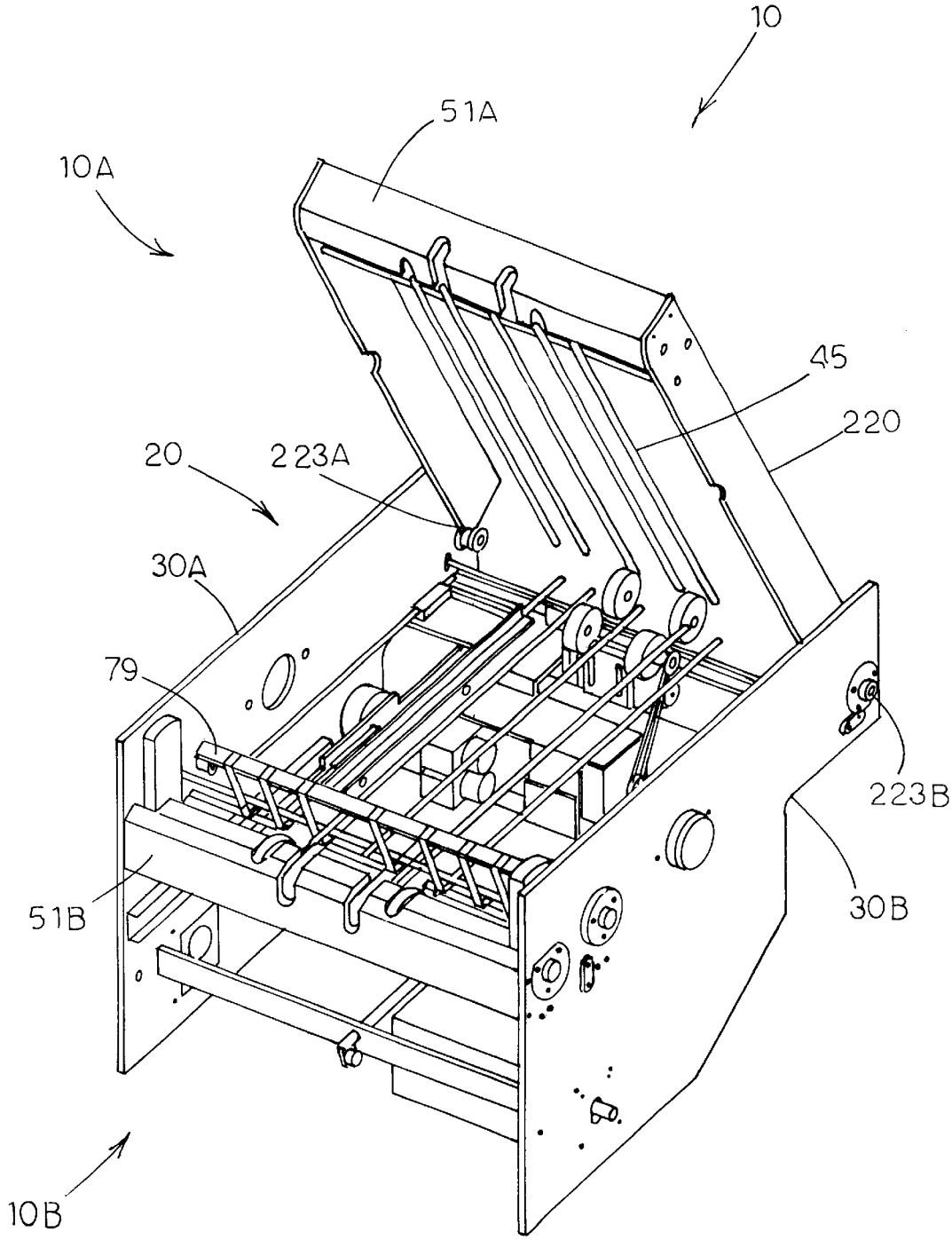
FIG. 16 is a perspective view of the accumulating apparatus illustrated in FIG. 1, wherein an upper section of the apparatus has been pivoted away from a lower section thereof.

In general, accumulating apparatus 10 comprises an input section, generally designated 15; an accumulation area, generally designated 20; and an output section, generally designated 25. Arrow F in FIG. 1 indicates the general direction of material flow through accumulating apparatus 10. As understood by persons skilled in the art, the various components comprising input section 15, accumulation area 20, and output section 25 are disposed in relation to a framework assembly of accumulating apparatus 10. The framework assembly can comprise a number of various structural members as appropriate for assembling accumulating apparatus 10 into an integrated unit. As shown in FIG. 16, for example, the framework assembly can include lateral support plates 30A and 30B. It will be further understood that accumulating apparatus 10 can be situated in-line between upstream and downstream modules as part of a larger material processing system. Non-limiting examples of upstream modules include feeders, cutters, readers, folders, stagers, and turnover devices. Non-limiting examples of downstream modules include readers, stagers, turnover devices, folders, inserts, diverters, envelope stuffers, postage meters, and finishers (e.g., stitchers, binders, shrink wrappers, or the like).

In operation, accumulating apparatus 10 is initially set to perform either over-accumulation or under-accumulation by manipulating outer thumb knobs or levers 41A and 41B and inner thumb knobs or levers 43A and 43B, as described in more detail hereinbelow. An upstream module or other means is used to feed either individual sheets of material or subsets of sheets sequentially into input section 15. Hence, as used hereinafter, the term "sheet" denotes either a single sheet or a subset of sheets, it being understood that accumulating apparatus 10 is capable of producing an accumulated sheet set from either a plurality of individually in-fed sheets or a plurality of in-fed, previously accumulated subsets of sheets. As a general matter, "sheets" can constitute any form of material units capable of being processed by document handling equipment.

As described in more detail hereinbelow, input section 15 controls the speed of the incoming sheets according to a dynamic speed profile as the sheets are being fed into accumulation area 20. Once a sheet enters accumulation area 20, that sheet is held while other sheets are permitted to enter accumulation area 20 either under or over the first sheet. If accumulating apparatus 10 is set to over-accumulate sheets in accumulation area 20, the first sheet entering accumulation area 20 becomes the bottom-most sheet in the resulting stack of accumulated sheets. If, on the other hand, accumulating apparatus 10 is set to under-accumulate sheets, the first sheet becomes the top-most sheet in the resulting stack of accumulated sheets.

As sheets are accumulated in the accumulation area 20, the leading edge, trailing edge, and lateral edges of each sheet are registered or justified, so that all sides of the resulting stack are squared off in preparation for subsequent advancing of the sheet stack to a downstream site (e.g., a downstream sheet set processing module). In at least one embodiment, an adjustable front stop mechanism (described hereinbelow) is utilized to register the leading edge of each incoming sheet. In at least one other embodiment, a jogging mechanism (described hereinbelow) is used to assist in registering the lateral edges of the sheets in the accumulating stack. Once a predetermined number of sheets have accumulated in accumulation area 20, such as by employing conventional sensing or counting means, a transport mechanism (described hereinbelow) generally situated within accumulation area 20 advances the stack into output section 25, from which the sheet set is transported from accumulating apparatus 10 to the downstream site.

As shown in FIG. 1, a set of top elongate support (or sheet guide) members comprising rods 45 and a set of bottom elongate support (or sheet guide) members comprising rods 47 extend through accumulation area 20, and respectively define upper and lower structural boundaries for the set of material units accumulating in accumulation area 20. Preferably, two or more corresponding pairs of top support rods 45 and bottom support rods 47 are provided, with each pair being laterally spaced from adjacent pairs. Top and bottom support rods 45 and 47 are passive elements. As such, top and bottom support rods 45 and 47 do not impart active forces to the sheets, and thus do not smudge the sheets. In furtherance of the smudge-free operation of accumulating apparatus 10, it is also preferable that top and bottom support rods 45 and 47 be cylindrical so as to present the smallest possible contact area for the sheets.

Figure 2:
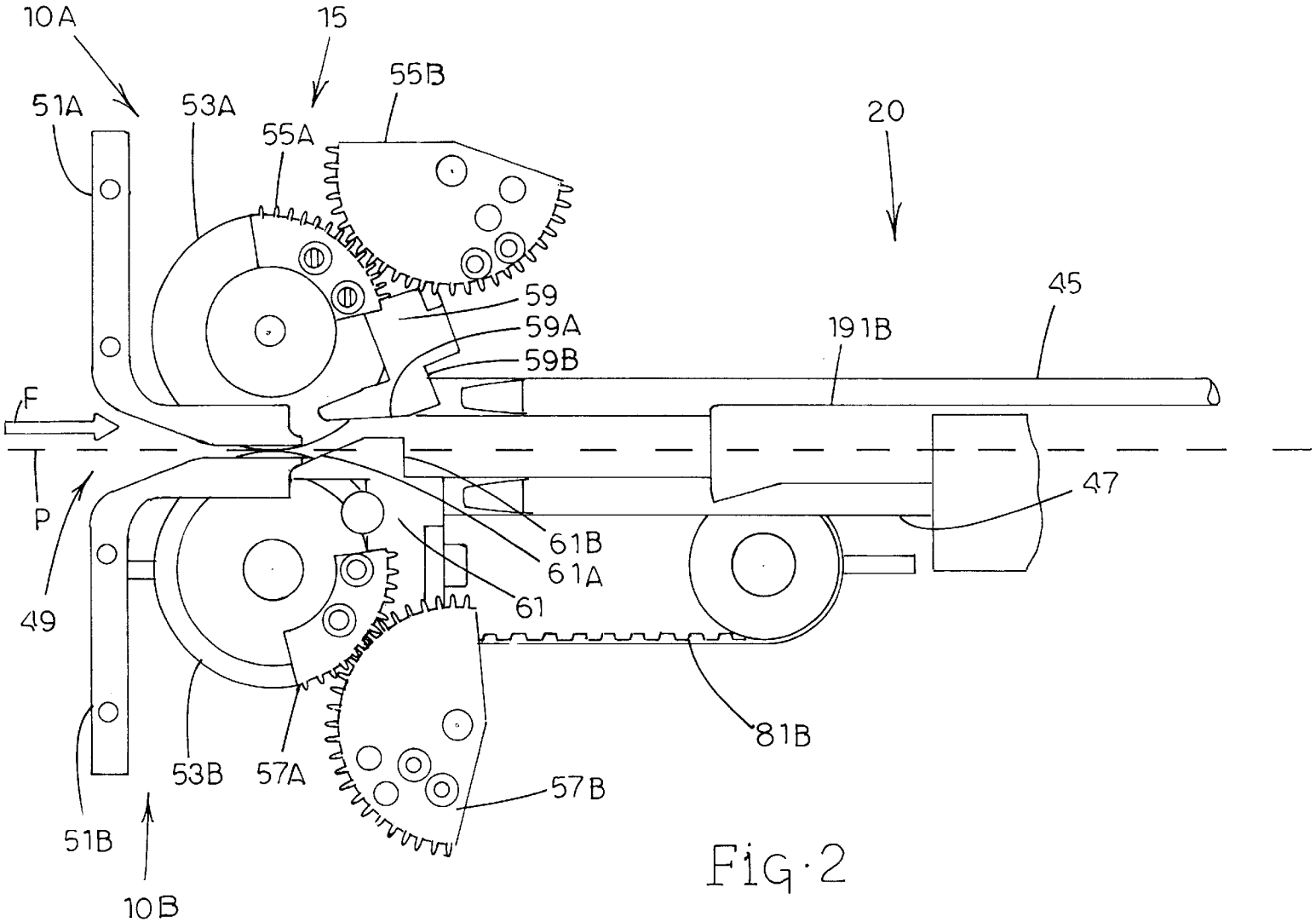
FIG. 2 is a side elevation view of an upstream region of the accumulating apparatus illustrated in FIG. 1.

Referring to FIG. 2, the material flow path indicated by arrow F through accumulating apparatus 10 is directed generally along a central sheet feed plane P. Central sheet feed plane P thus also indicates the general flow path of sheets through accumulating apparatus 10, and further provides a general demarcation between upper and lower sections of accumulating apparatus 10. In FIG. 2, upper section is generally designated 10A and lower section is generally designated 10B.

Input section 15 (FIG. 2) of accumulating apparatus 10 comprises an entrance area, generally designated 49, defined at least in part by a top entrance guide 51A disposed in upper section 10A of accumulating apparatus 10 above central sheet feed plane P and a bottom entrance guide 51B disposed in lower section 10B below central sheet feed plane P. Input section 15 further comprises a dynamic in-feed mechanism, which preferably includes a pair of dynamic in-feed rollers 53A and 53B. Top in-feed roller 53A is disposed in upper section 10A of accumulating apparatus 10 above central sheet feed plane P, and bottom in-feed roller 53B is disposed in lower section 10B below central sheet feed plane P. Hence, a nip is formed between top and bottom in-feed rollers 53A and 53B that is generally situated about central sheet feed plane P.

The coupling of one of in-feed rollers 53A or 53B to a variable-speed motor (not shown) renders the rollers "dynamic" in the sense that their rotational speed is variable over a given range (for example, approximately 80 ips to approximately 180 ips, where "ips" denotes "inches per second"). For each cycle, defined for the present purpose as a sheet being fed through input section 15 and into accumulation area 20 (and accumulating over or under the pre-existing stack, if any), the dynamic speed profile is characterized by an initial input speed (preferably matched with the output speed of the upstream module) followed by a ramping down of the speed as the sheet enters accumulation area 20 and abuts the front stop mechanism provided. The ramp of deceleration that forms a part of the dynamic speed profile can be associated with a constant rate of deceleration or a non-linear rate. As one example, the initial in-feed speed can be 180 ips, which is thereafter dynamically slowed down according to a predetermined speed profile to a lower speed of 80 ips.

Input section 15 also comprises a switchable over/under accumulating mechanism that comprises the following components. First and second top gears or gear segments 55A and 55B, respectively, are mounted in upper section 10A of accumulating apparatus 10 above central sheet feed plane P, and rotate about respective parallel axes in meshing engagement with each other. Similarly, first and second bottom gears or gear segments 57A and 57B, respectively, are mounted in lower section 10B of accumulating apparatus 10 below central sheet feed plane P, and rotate about respective parallel axes in meshing engagement with each other. Thus, first and second top gear segments 55A and 55B rotate in opposite senses with respect to each other, and first and second bottom gear segments 57A and 57B rotate in opposite senses with respect to each other. In a preferred embodiment, first top gear 55A and top in-feed roller 53A rotate about the same axis, and first bottom gear 57A and bottom in-feed roller 53B rotate about the same axis.

The over/under accumulating mechanism further comprises one or more top accumulation ramps 59 and one or more bottom accumulation ramps 61. Top accumulation ramps 59 are linked in mechanical relation to first top gear segment 55A and rotate therewith, and bottom accumulation ramps 61 are linked in mechanical relation to first bottom gear segment 57A and rotate therewith. As shown in FIG. 2, top and bottom accumulation ramps 59 and 61 preferably include respective inclined surfaces 59A and 61A and backstop surfaces 59B and 61B. One or more top hold-down spring fingers 63 (see FIG. 4) are linked in mechanical relation to second top gear segment 55B and rotate therewith, and one or more bottom top hold-down spring fingers 65 (see FIG. 4) are linked in mechanical relation to second bottom gear segment 57B and rotate therewith. The top hold-down spring fingers 63 and the bottom hold-down spring fingers 65 are exemplary embodiments of upper and lower retaining members linked to the top and bottom ramps 59 and 61 via respective gear sets 55A, 55B, and 57A, 57B.

Figure 4:
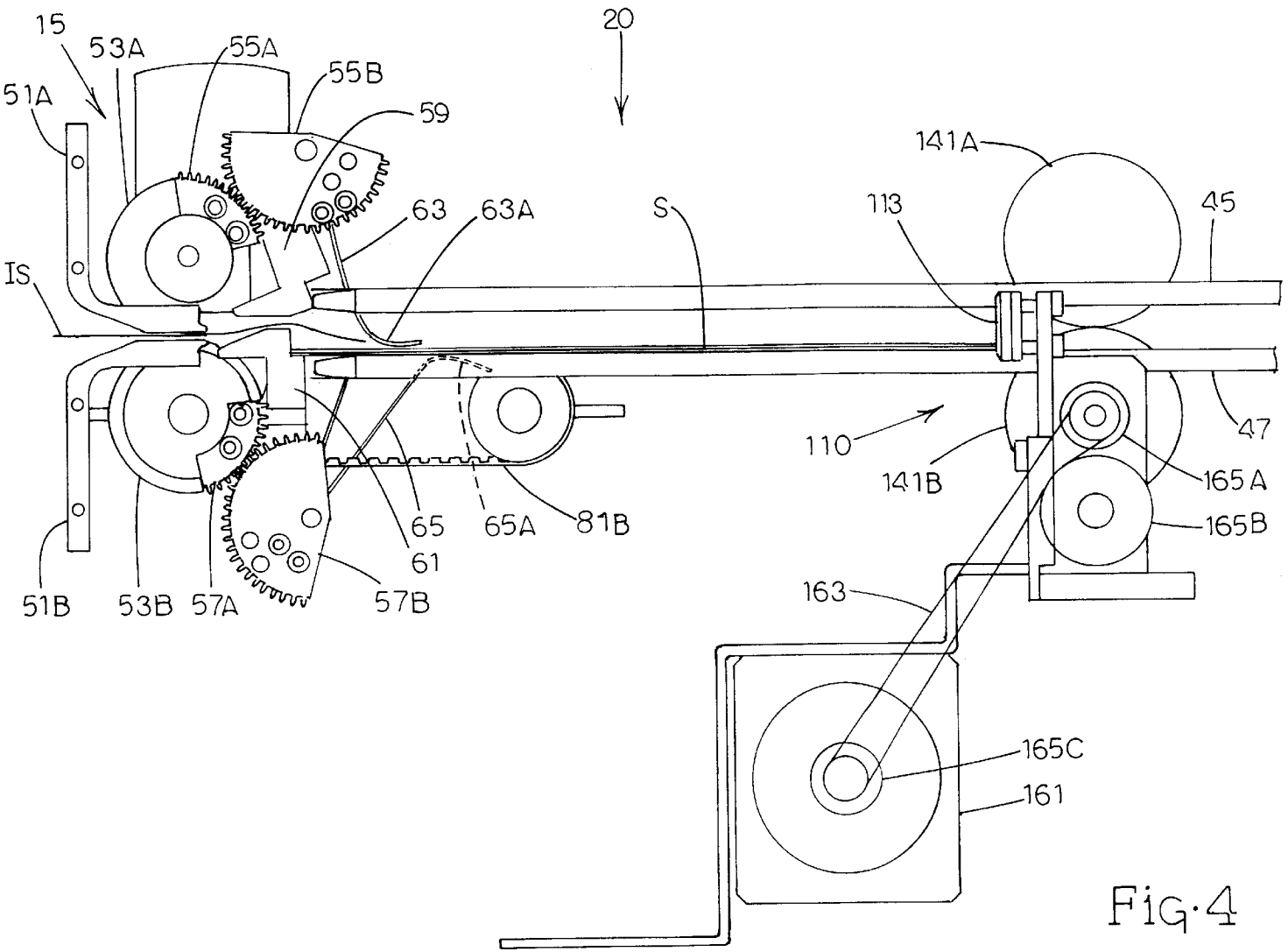
FIG. 4 is a side elevation view of an upstream region of the accumulating apparatus illustrated in FIG. 1, showing the apparatus operating in an over-accumulating mode.

Preferably, top and bottom hold-down fingers 63 and 65 include respective arcuate sections 63A and 65A as shown in FIG. 4. Each arcuate section 63A and 65A can be constructed as a continuous member or as a contiguous series of differently angled segments. Each of top and bottom hold-down fingers 63 and 65 is constructed of such physical dimensions and material composition as to be capable of storing spring energy. Hence, top and bottom hold-down fingers 63 and 65 are deflectable upon encountering a force and recoverable to an initial profile upon subsequent removal of the force. Inclined surfaces 59A and 61A of respective top and bottom accumulation ramps 59 and 61, and arcuate sections 63A and 65A of respective top and bottom hold-down fingers 63 and 65, selectively interact with incoming sheets as described hereinbelow. The selectivity depends on whether the over-accumulation mode or under-accumulation mode is active. As also described hereinbelow, respective back-stop surfaces 59B and 61B of top and bottom accumulation ramps 59 and 61 assist in selectively registering the trailing edge of the stack of sheets.

Figure 3:
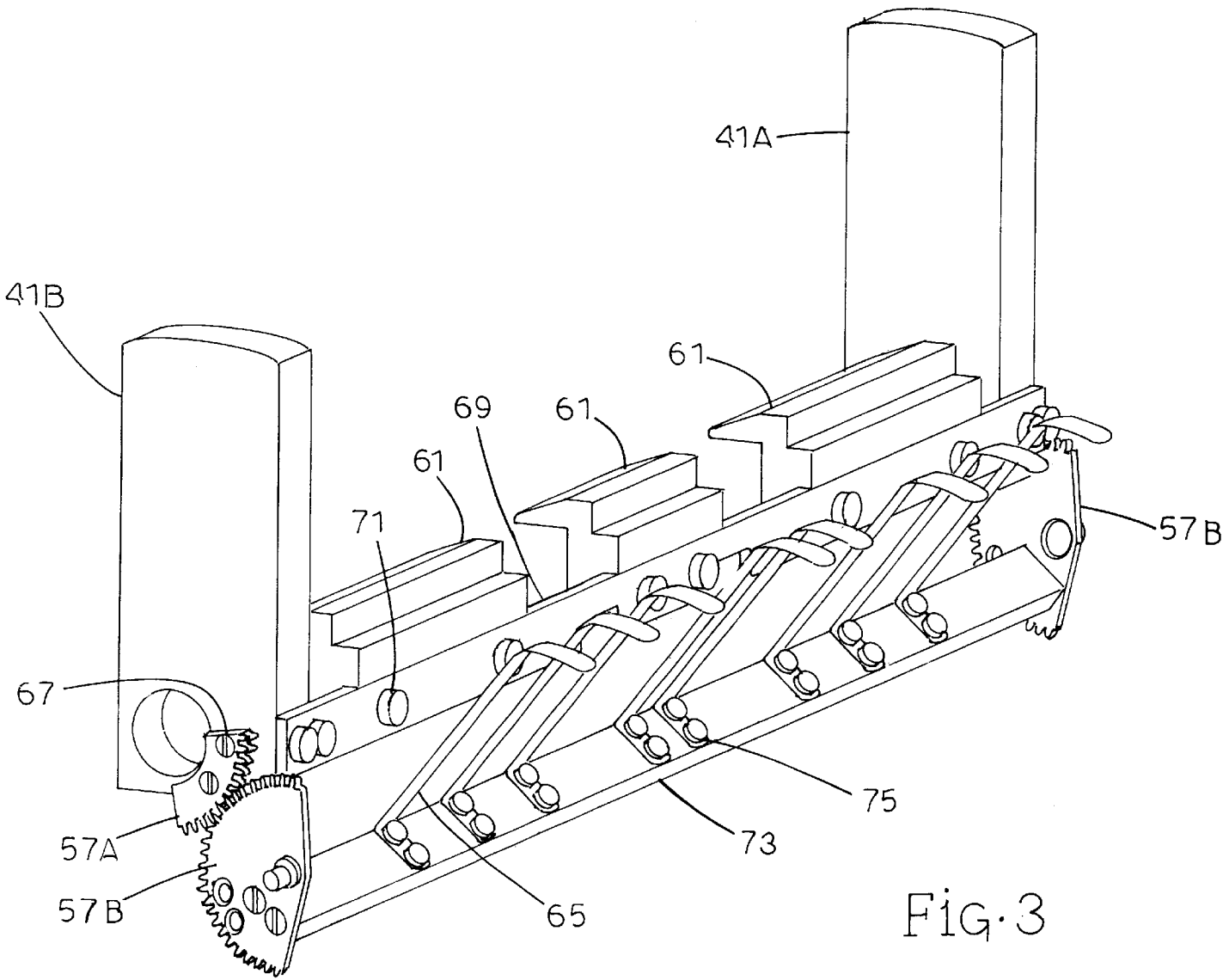
FIG. 3 is a perspective view of a portion of an accumulating assembly provided with the accumulating apparatus illustrated in FIG. 1.

Referring to FIG. 3, the mechanical arrangement of outer knobs 41A and 41B, first and second bottom gear segments 57A and 57B, bottom accumulation ramps 61, and bottom hold-down fingers 65 are illustrated in accordance with a preferred embodiment of the invention. Each outer knob 41A and 41B is connected to its corresponding first bottom gear segment 57A by one or more suitable fasteners 67, such that rotation of outer knobs 41A and 41B likewise causes first bottom gear segments 57A to rotate. Each bottom accumulation ramp 61 is connected to a support member 69 by one or more suitable fasteners 71. Support member 69 is connected between outer knobs 41A and 41B and thus rotates therewith. Each bottom hold-down finger 65 is connected to another support member 73 by one or more suitable fasteners 75. Support member 73 is connected between second bottom gear segments 57B and thus rotates therewith. It will be understood that the mechanical arrangement of inner knobs 43A and 43B (see FIG. 1), first and second top gear segments 55A and 55B (see FIG. 2), top accumulation ramps 59, and top hold-down fingers 63 (see FIG. 4) can be analogously provided. Thus, in FIG. 1, top accumulation ramps 59 are connected to a support member 77, which is in turn connected between inner knobs 43A and 43B and thus rotates therewith. As shown in FIG. 16, a support member 79 is also employed for mounting top hold-down fingers 63 (FIG. 4) in mechanical connection with second top gear segments 55B.

Referring back to FIG. 2, the intermeshing of first and second top gear segments 55A and 55B operatively couples top accumulation ramps 59 and top hold-down fingers 63 together. Similarly, the intermeshing of first and second bottom gear segments 57A and 57B (see also FIG. 4) operatively couples bottom accumulation ramps 61 and bottom hold-down fingers 65 together. As described hereinabove, inner thumb knobs 43A and 43B (see FIG. 1) mechanically communicate with first top gear segments 55A (see also FIG. 4) and second top gear segments 55B so as to effect adjustment of the relative positions of top accumulation ramps 59 and top hold-down fingers 63. Similarly, outer thumb knobs 41A and 41B (see FIGS. 1 and 3) mechanically communicate with first bottom gear segments 57A and second bottom gear segments 57B so as to effect adjustment of the relative positions of bottom en accumulation ramps 61 and bottom hold-down fingers 65.

FIGS. 2 and 4 depict accumulating apparatus 10 in its over-accumulating mode. Inner thumb knobs 43A and 43B (see FIG. 1) are pivoted to cause the coupling interaction of first and second top gear segments 55A and 55B, top accumulation ramps 59 and top hold-down fingers 63. Outer thumb knobs 41A and 41B (see FIGS. 1 and 3) are pivoted to cause the coupling interaction of first and second bottom gear segments 57A and 57B, bottom accumulation ramps 61 and bottom hold-down fingers 65. As a result, and as shown in FIG. 4, top accumulation ramps 59 are disposed in a raised position out of the material flow path while, at the same time, top hold-down fingers 63 are disposed in a lowered position in the material flow path. Also at the same time, bottom accumulation ramps 61 are disposed in a raised position in the material flow path while bottom hold-down fingers 65 are disposed in a lowered position out of the material flow path. As described hereinbelow, this configuration results in an over-accumulation of sheets in accumulation area 20.

Figure 5:
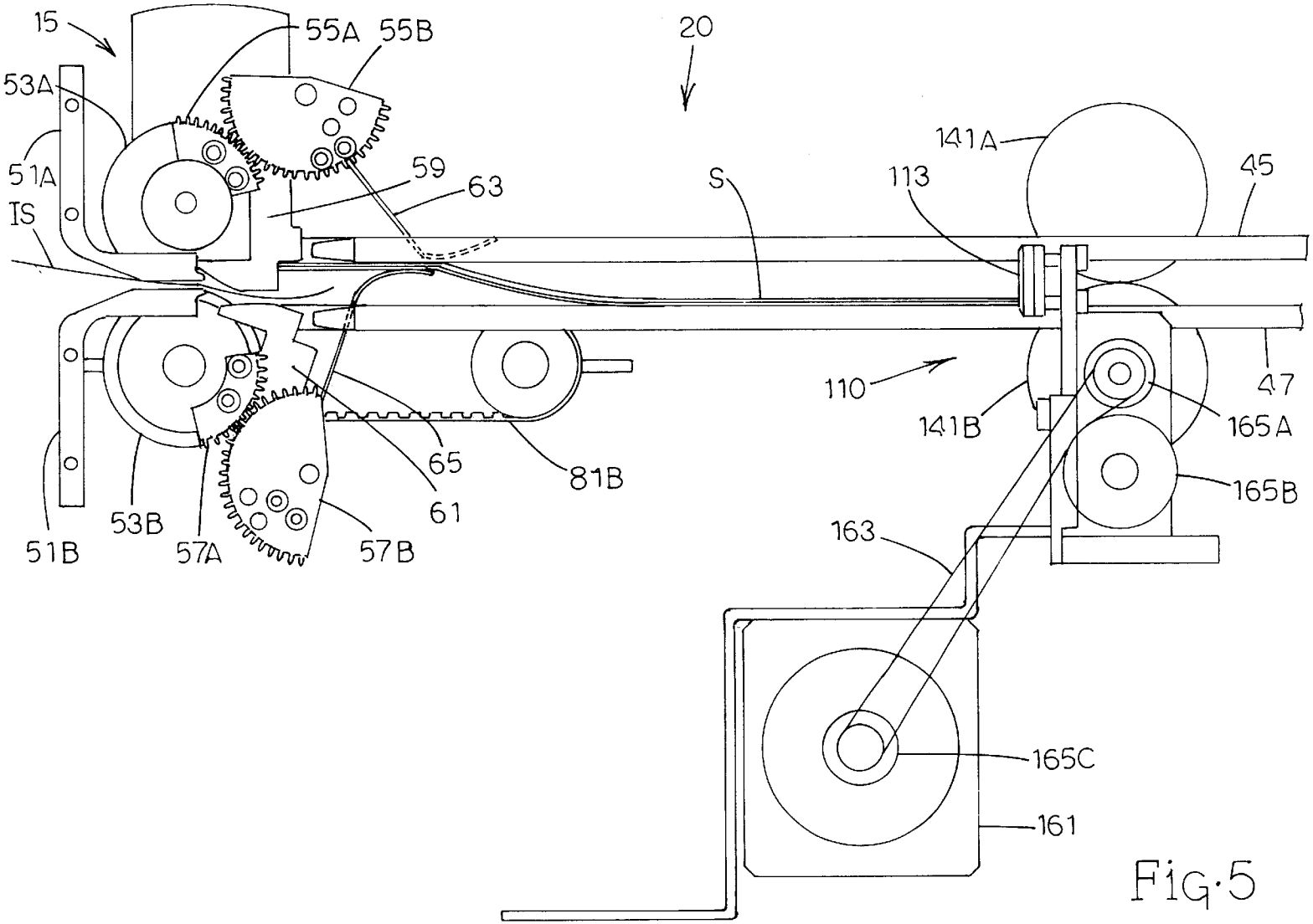
FIG. 5 is a side elevation view of an upstream region of the accumulating apparatus illustrated in FIG. 1, showing the apparatus operating in an under-accumulating mode.

Referring to FIG. 5, accumulating apparatus 10 has been converted to the under-accumulating mode by pivoting inner thumb knobs 43A and 43B and outer thumb knobs 41A and 41B to new positions. Top accumulation ramps 59 are now disposed in a lowered position in the material flow path, while top hold-down fingers 63 are disposed in a raised position out of the material flow path. At the same time, bottom accumulation ramps 61 are now disposed in a lowered position out of the material flow path, while bottom hold-down fingers 65 are disposed in a raised position in the material flow path. As described hereinbelow, this configuration results in an under-accumulation of sheets in accumulation area 20.

Figure 6:
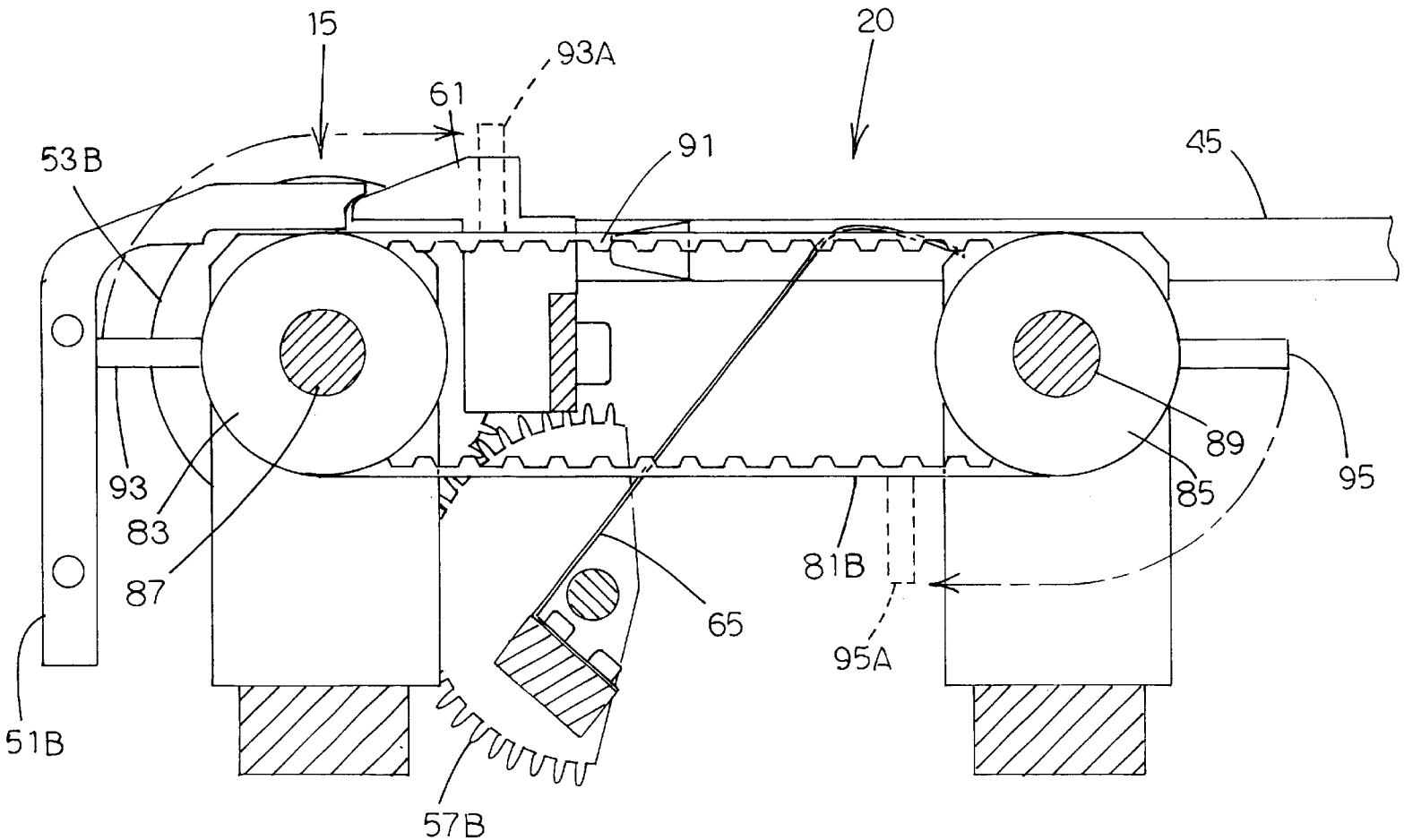
FIG. 6 is a side elevation view of a portion of the accumulating apparatus illustrated in FIG. 1, showing details of a transport device provided therewith.
Figure 7:
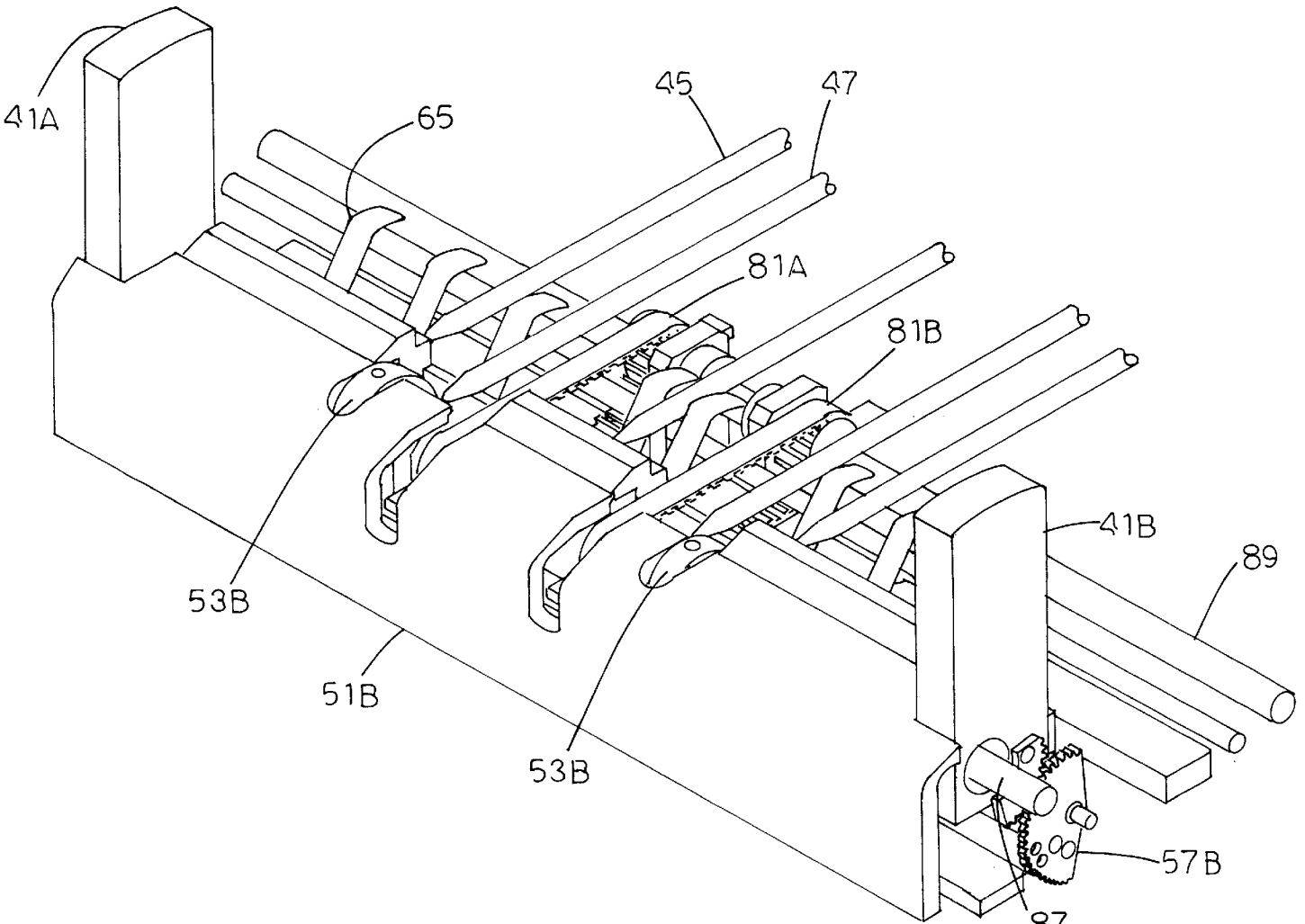
FIG. 7 is a perspective view of an upstream region of the accumulating apparatus illustrated in FIG. 1.

Referring now to FIGS. 6 and 7, one or more dual-lugged transport belts 81A and 81B are disposed at the interfacial region of input section 15 and accumulation area 20 of accumulating apparatus 10. Transport belts 81A and 81B rotate about rotatable elements such as pulleys 83 and 85 mounted to shafts 87 and 89, with one of shafts 87 and 89 being driven by a suitable motor (not shown). In a preferred embodiment, upstream-side pulleys 83 rotate about the same axis as lower infeed rollers 53B, and thus upstream-side shaft 87 can be a common axle engaged by both upstream-side pulleys 83 and lower infeed rollers 53B. The inner surface of each transport belt 81A and 81B includes a plurality of inside lugs 91 that engage ribbed pulleys 83 and 85 in order to positively drive transport belts 81A and 81B. The outside surface of each transport belt 81A and 81B, likewise includes outside lugs 93 and 95 of suitable design (see FIG. 6) for engaging the trailing edge of a sheet or sheets. Suitable designs of such outside lugs 93 and 95 are known in the art. In one exemplary embodiment, each transport belt 81A and 81B includes two outside lugs 93 and 95 cyclically spaced 180 degrees apart from each other, with each outside lug 93 and 95 of one transport belt 81A being situated in phase with each corresponding outside lug 93 of the other transport belt 81B. The upper run of each transport belt 81A and 81B is disposed at a high enough elevation within accumulation area 20 so as to enable outside lugs 93 to contact the trailing edge of the sheet stack residing in accumulation area 20, thereby permitting transport belts 81A and 81B to advance the sheet stack through accumulation area 20 along the material flow path. In FIG. 6, the positions of lugs 93 and 95 are designated 93A and 95A, respectively, at the moment before lug 93A contacts a sheet stack.

Figure 8:
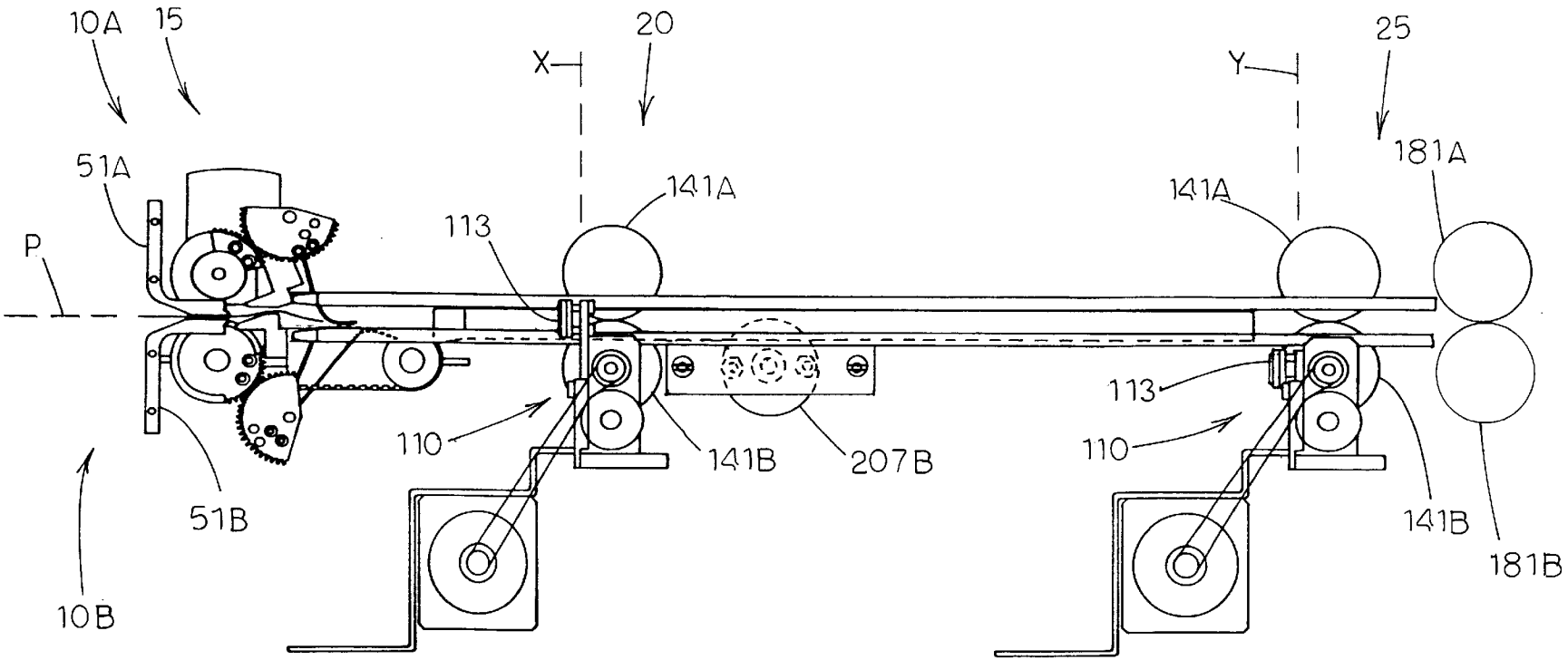
FIG. 8 is a side elevation view of the accumulating apparatus illustrated in FIG. 1.

Referring now to FIGS. 8–11, a front stop mechanism, generally designated 110, is disposed generally within accumulation area 20. The longitudinal position of front stop mechanism 110 with respect to input section 15 is adjustable in order to accommodate different lengths of sheets. In FIG. 8, for example, front stop mechanism 110 is shown disposed at a position X at which sheets of a relatively short length (e.g., 3.50 inches) can be accommodated, and is also alternatively shown disposed at a position Y at which sheets of a relatively long length (e.g., 14.0 inches) can be accommodated. Front stop mechanism 110 in a preferred embodiment comprises spring-loaded, retractable front stop fingers 113. Front stop fingers 113 are alternately extended across central sheet feed plane P (and thus in the material flow path) or retracted below central sheet feed plane P (and thus out of the material flow path). In FIG. 8, for purposes of illustration, front stop fingers 113 are shown in the extended position at position X of front stop mechanism 110 and in the retracted position at position Y of front stop mechanism 110. It will be understood, however, that front stop fingers 113 are alternately extendable and retractable during the operation of accumulating apparatus 10 at all positions of front stop mechanism 110 available along the length of accumulation area 20.

Figure 9:
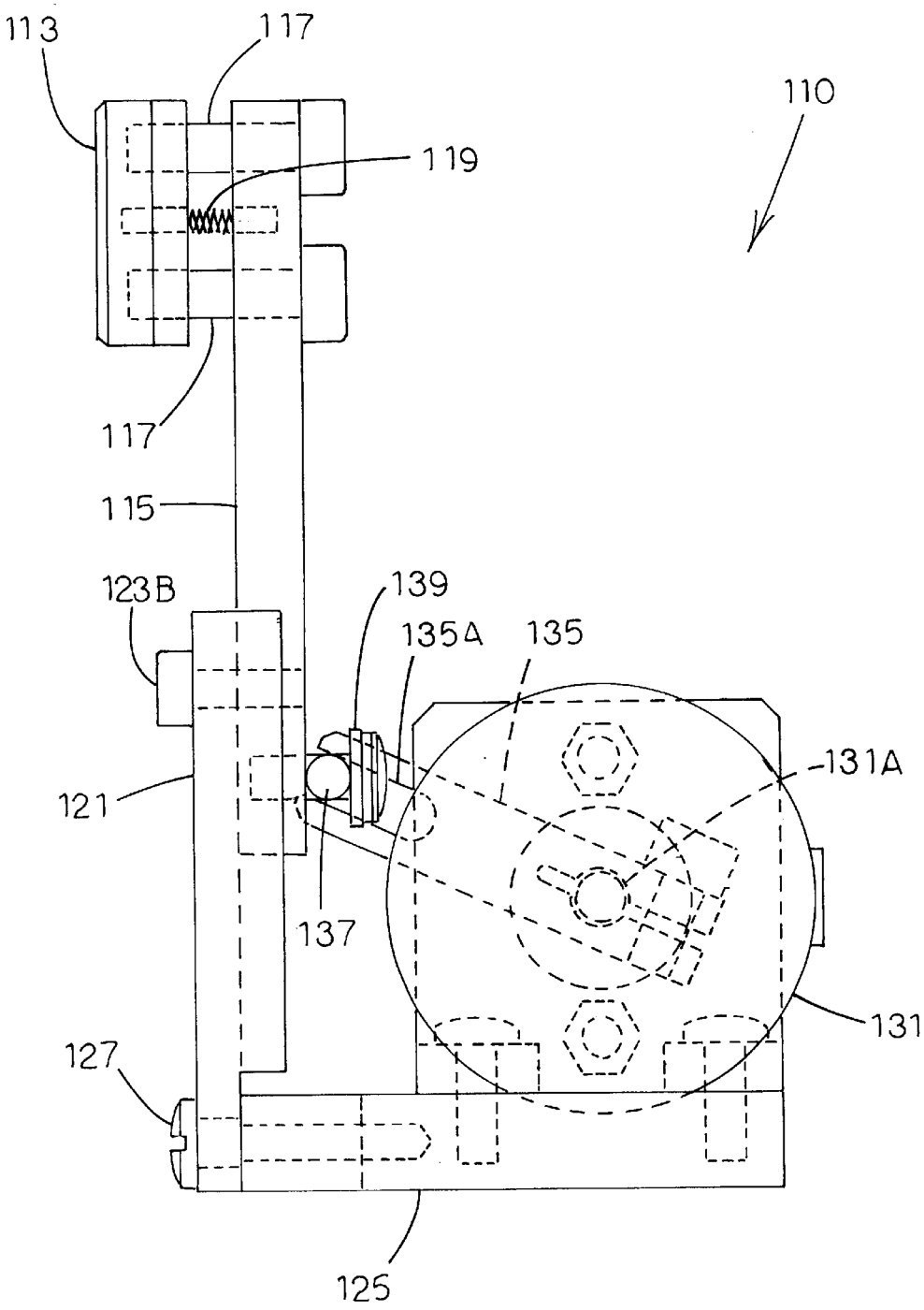
FIG. 9 is a side elevation view in partial phantom of a front stop mechanism.
Figure 10:
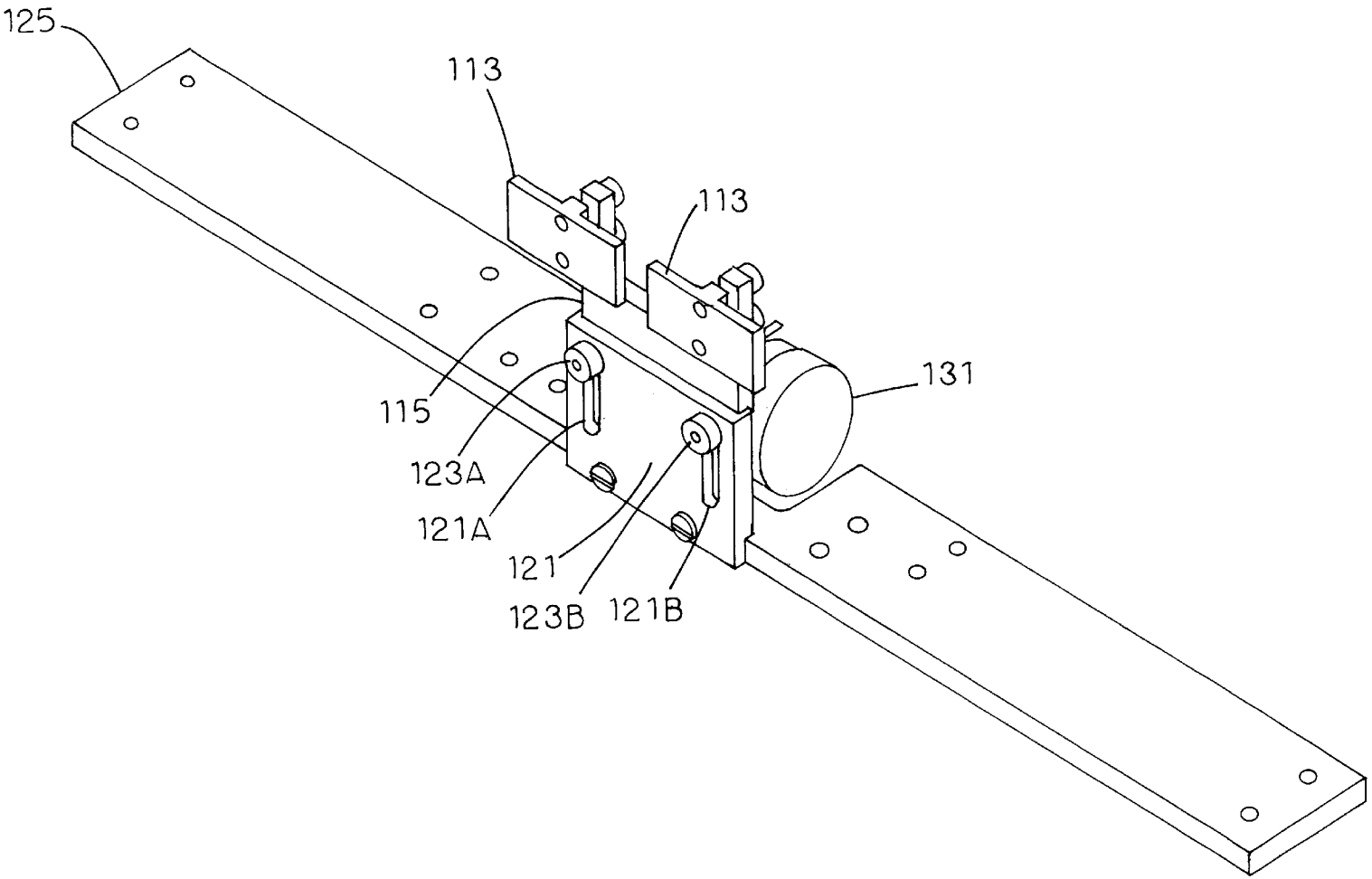
FIG. 10 is a perspective view of the front stop mechanism illustrated in FIG. 9.
Figure 11:
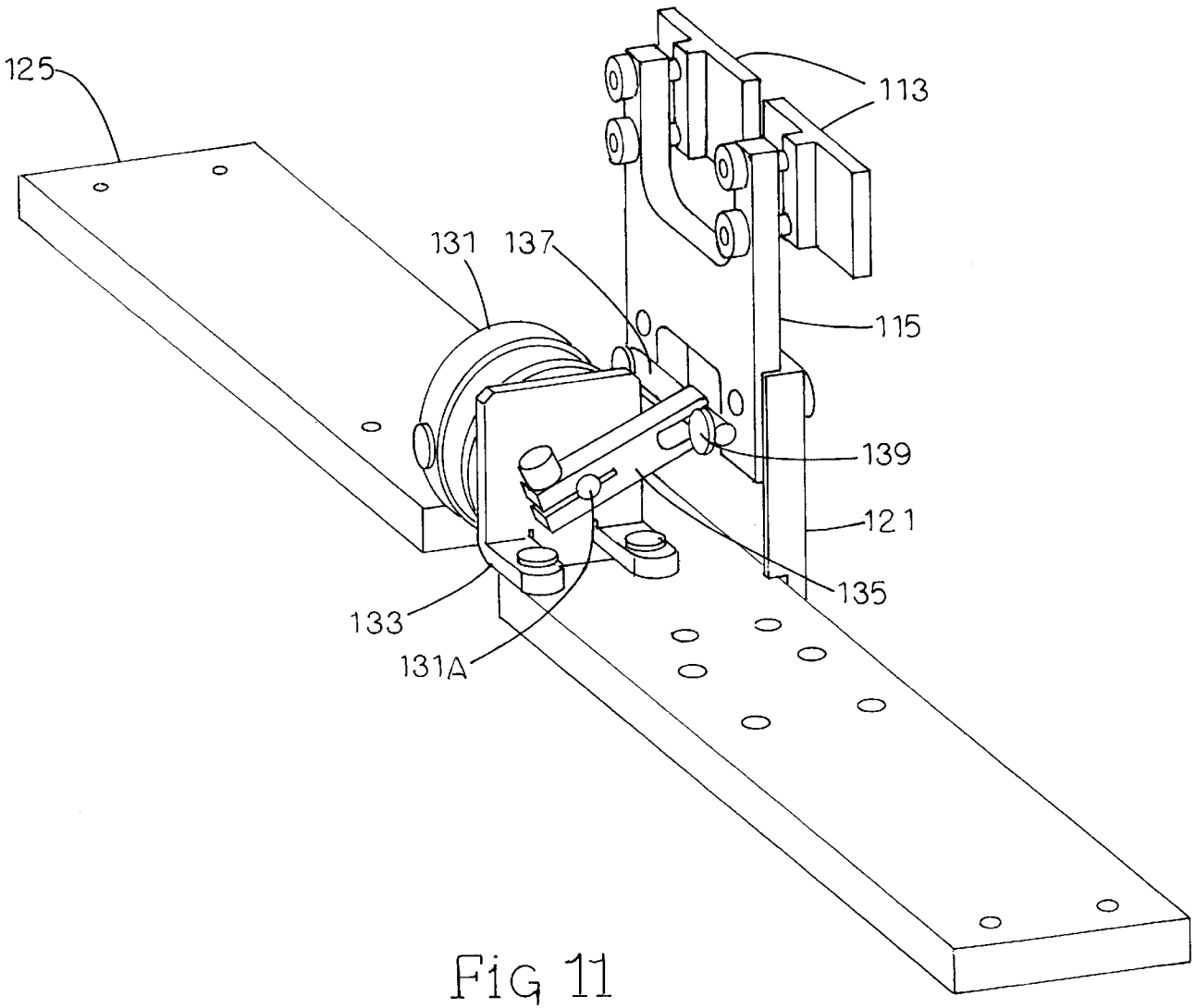
FIG. 11 is another perspective view of the front stop mechanism illustrated in FIG. 9.

Referring to FIGS. 9–11, further details of the front stop mechanism 110 are shown. Each front stop finger or plate 113 is connected to a vertical slide plate 115 using shoulder bolts 117 or other suitable securing means. A compression spring 119 is interposed between each front stop finger 113 and vertical slide plate 115 to enable each front stop finger 113 to recoil to a degree sufficient to jog sheets entering into the accumulation area 20, thereby registering the sheets along their respective lead edges. Preferably, compression springs 119 are generally axially aligned with central sheet feed plane P (see FIG. 8) when front stop fingers 113 are extended. Vertical slide plate 115 is connected to a guide plate 121 through one or more guide members 123A and 123B. Guide plate 121 is mounted to a support plate 125 by means of one or more suitable fasteners such as bolts 127. Guide members 123A and 123B are movable within respective slots 121A and 121B formed through guide plate 121 (see FIG. 10) to enable vertical slide plate 115 to slide vertically with respect to guide plate 121. The interaction of vertical slide plate 115 with guide plate 121 thus enables front stop fingers 113 to move into and out of the material feed path as described hereinabove.

A powered drive source adapted for reversible rotary power transfer, such as a rotary solenoid or reversible motor 131, is mounted to support plate 125 through a suitable mounting bracket 133 (see FIG. 11) and includes an output shaft 131A. An actuating arm 135 having a U-slot (designated 135A in FIG. 9) is connected to output shaft 131A, such that rotation of output shaft 131A clockwise or counterclockwise rotates actuating arm 135 in a like manner. Actuating arm 135 is linked to vertical slide plate 115 by means of a transverse pin 137. Transverse pin 137 is secured to vertical slide plate 115 through one or more suitable fasteners such as bolts 139. Transverse pin 137 is situated within U-slot 135A of actuating arm 135, and thus is movable along the length of U-slot 135A. Accordingly, rotation of actuating arm 135 in one direction imparts an upward force to transverse pin 137 and results in vertical slide plate 115 sliding upwardly, while rotation of actuating arm 135 in the other direction imparts a downward force to transverse pin 137 and results in vertical slide plate 115 sliding downwardly.

Referring back to FIG. 8, one or more pairs of output rollers 141A and 141B are associated with front stop mechanism 110. Top output roller 141A is disposed in upper section 10A of accumulating apparatus 10 above central sheet feed plane P, and bottom output roller 141B is disposed in lower section 10B below central sheet feed plane P. Hence, a nip is formed between top and bottom output rollers 141A and 141B that is generally situated about central sheet feed plane P. In the case where a downstream material processing device operates in connection with accumulating apparatus 10, the rotational speed of output rollers 141A and 141B is preferably matched to the speed of the downstream device, which ordinarily is a constant speed falling within the approximate range of, for example, 80 ips to 180 ips. Output rollers 141A and 141B are disposed at a fixed distance downstream from front stop fingers 113, yet are longitudinally adjustable with front stop fingers 113 along the length of accumulation area 20 to accommodate different sizes of sheets.

Figure 12:
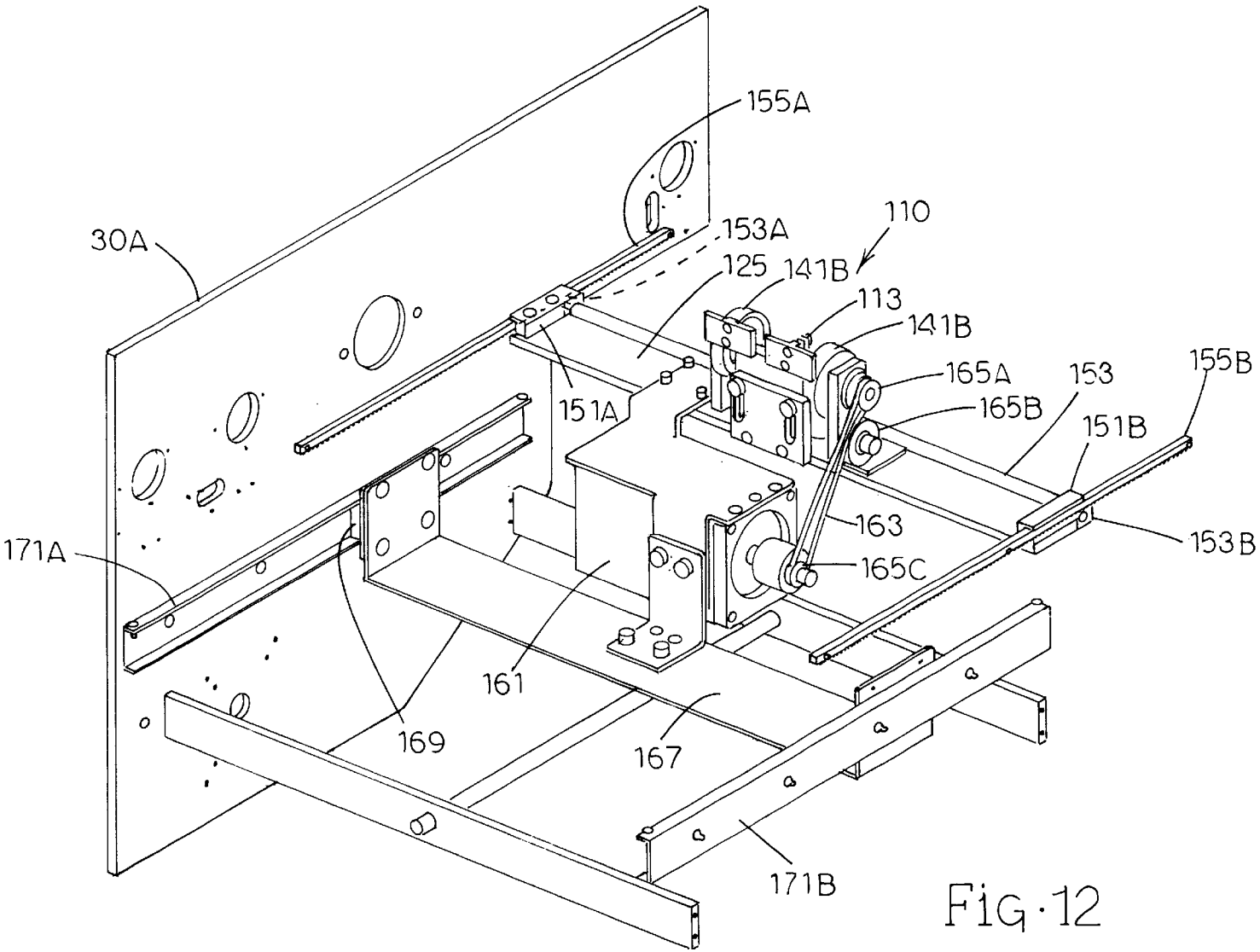
FIG. 12 is a perspective view of a carriage assembly.

Referring now to FIG. 12, a carriage assembly is illustrated that enables the position of front stop mechanism 110 and its associated output rollers 141A and 141B to be adjusted as described hereinabove. In FIG. 12, for purposes of clarity, only lower output rollers 141B are shown with the understanding that upper output rollers 141A are also provided to form one or more pairs of nip rollers (as shown in FIGS. 4, 5 and 8). In addition to the front stop mechanism 110, output rollers 141A and 141B are also mounted to support plate 125. A carriage member 151A and 151B is secured to each lateral end of support member 125. A pinion gear 153 traverses the full length of support plate 125 and has ends 153A and 153B mounted within corresponding carriage members 151A and 151B. Each pinion gear end 153A and 153B engages a respective rack gear 155A and 155B. This configuration assists in maintaining the parallel/perpendicular positioning of front stop mechanism 110. Each rack gear 155A and 155B is respectively mounted to a lateral support plate 30A and 30B (only one of which is shown in FIG. 12). Lateral support plates 30A and 30B form a part of the main frame assembly of accumulating apparatus 10, as shown in FIG. 16. The meshing between pinion gear ends 153A and 153B and their corresponding rack gears 155A and 155B enable front stop mechanism 110 and output rollers 141A and 141B to translate back and forth together in a controlled manner, along the direction of material travel. This translational adjustment could be effected manually or by automated means. For example, the shaft position of pinion gear 153 could be made to engage an appropriate motor and transmission assembly so as to transfer power to carriage members 151A and 151B through the engagement of pinion gear ends 153A and 153B and rack gears 155A and 155B.

Output rollers 141A and 141B are driven by an output roller drive motor 161 and associated drive belt 163 and pulleys 165A, 165B and 165C. The position of this motor 161 is also adjustable with output rollers 141A and 141B and front stop mechanism 110. This is accomplished by mounting output roller drive motor 161 to a sliding motor support plate 167. The lateral ends of sliding motor support plate 167 are connected to guide members 169 (only one of which is visible in FIG. 12) that slide along the lengths of respective side rails 171A and 171B. Each side rail 171A and 171B is secured to a respective lateral support plate 30A and 30B of accumulating apparatus 10.

Referring back to FIGS. 1 and 8, output section 25 of accumulating apparatus 10 comprises one or more pairs of exit rollers 181A and 181B. For each pair of exit rollers 181A and 181B provided, top exit roller 181A is disposed in upper section 10A of accumulating apparatus 10 above central sheet feed plane P, and bottom exit roller 181B is disposed in lower section 10B below central sheet feed plane P (in FIG. 1, only bottom exit rollers 181B are shown for clarity). Exit rollers 181A and 181B form a nip that is generally situated about central sheet feed plane P. The speed of exit rollers 181A and 181B is matched to that of output rollers 141A and 141B and thus to that of the downstream device.

Figure 13:
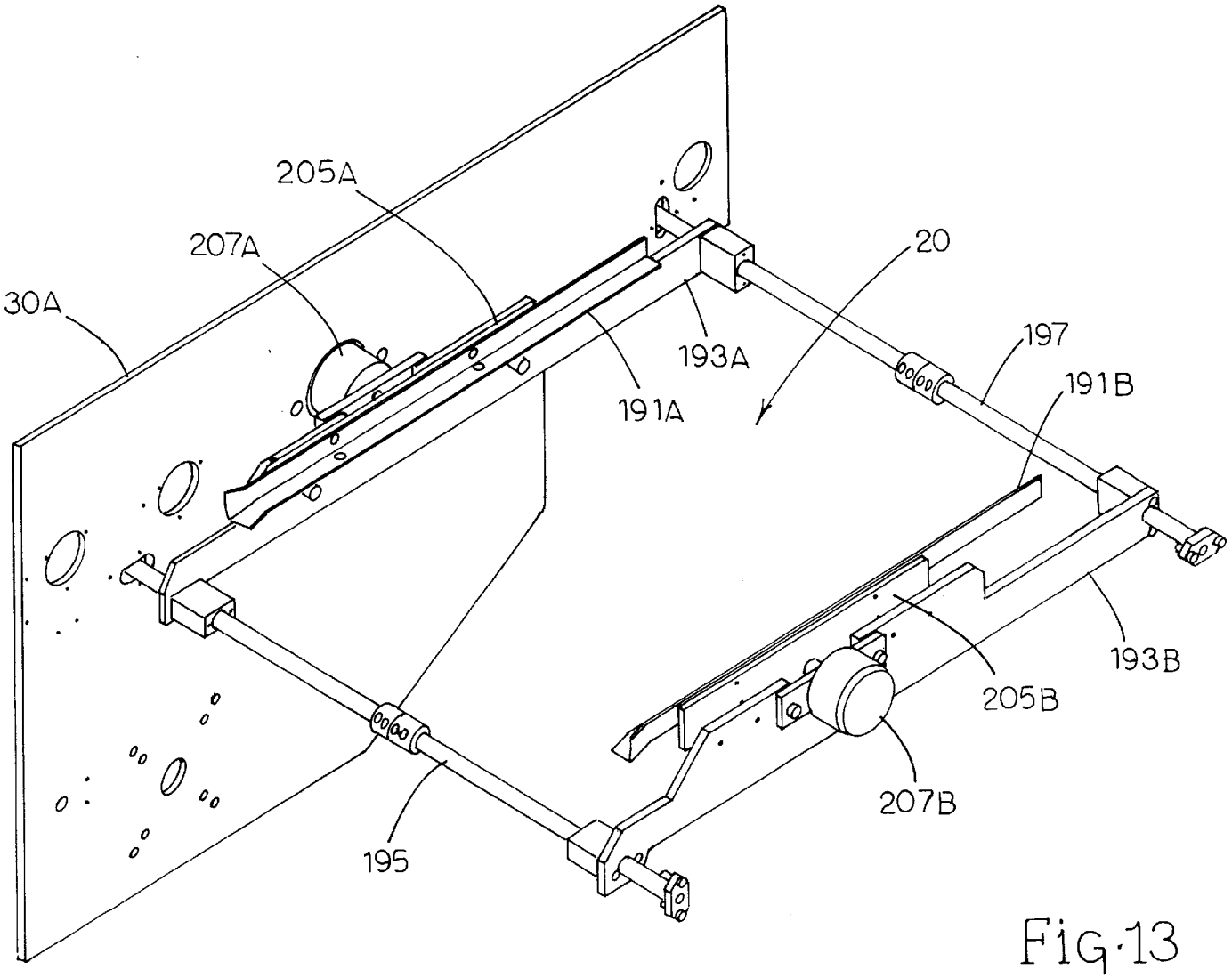
FIG. 13 is a perspective view of a side-to-side jogging assembly.
Figure 14:
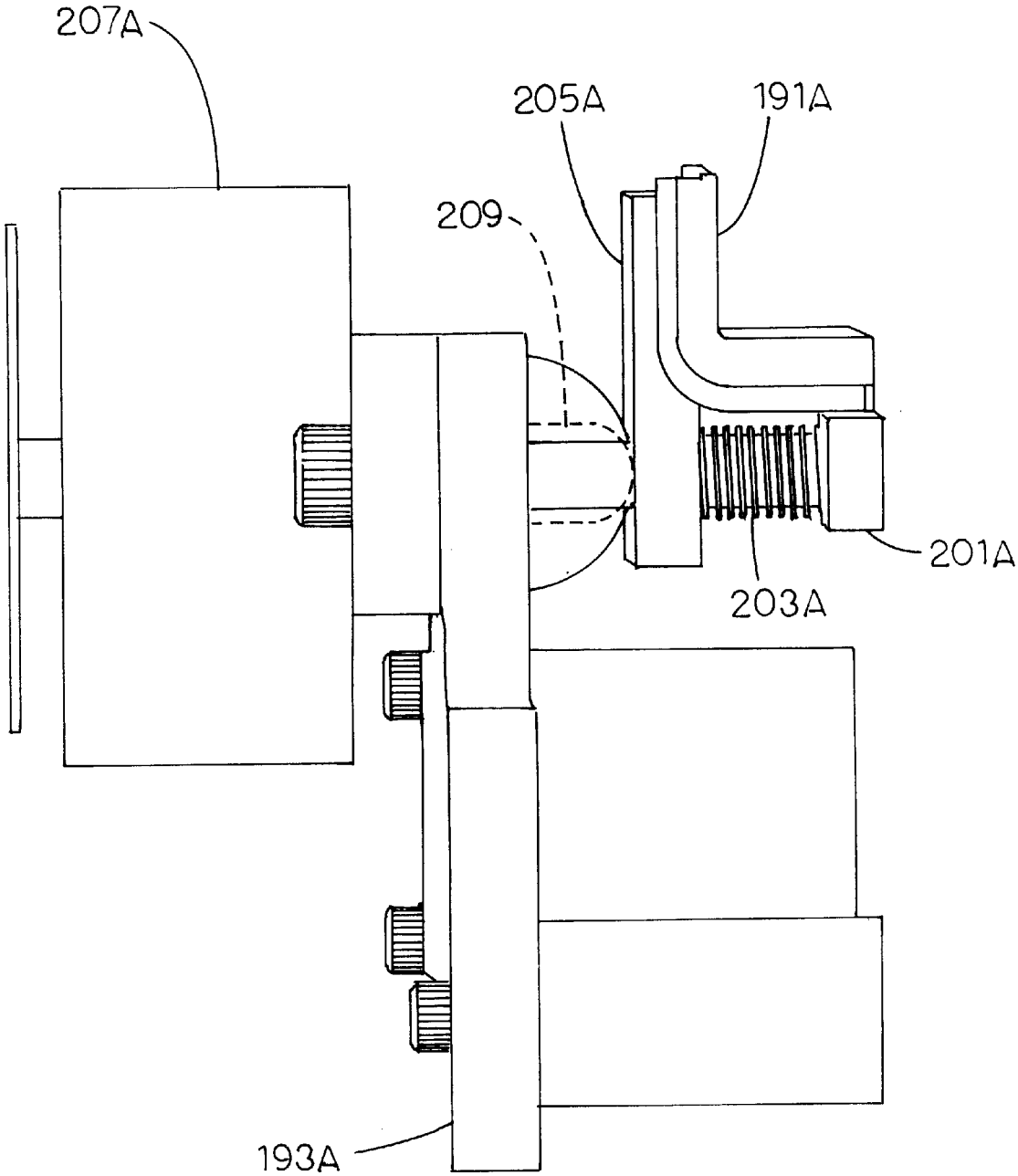
FIG. 14 is a side elevation view of one portion of the side-to-side jogging assembly illustrated in FIG. 13.
Figure 15:
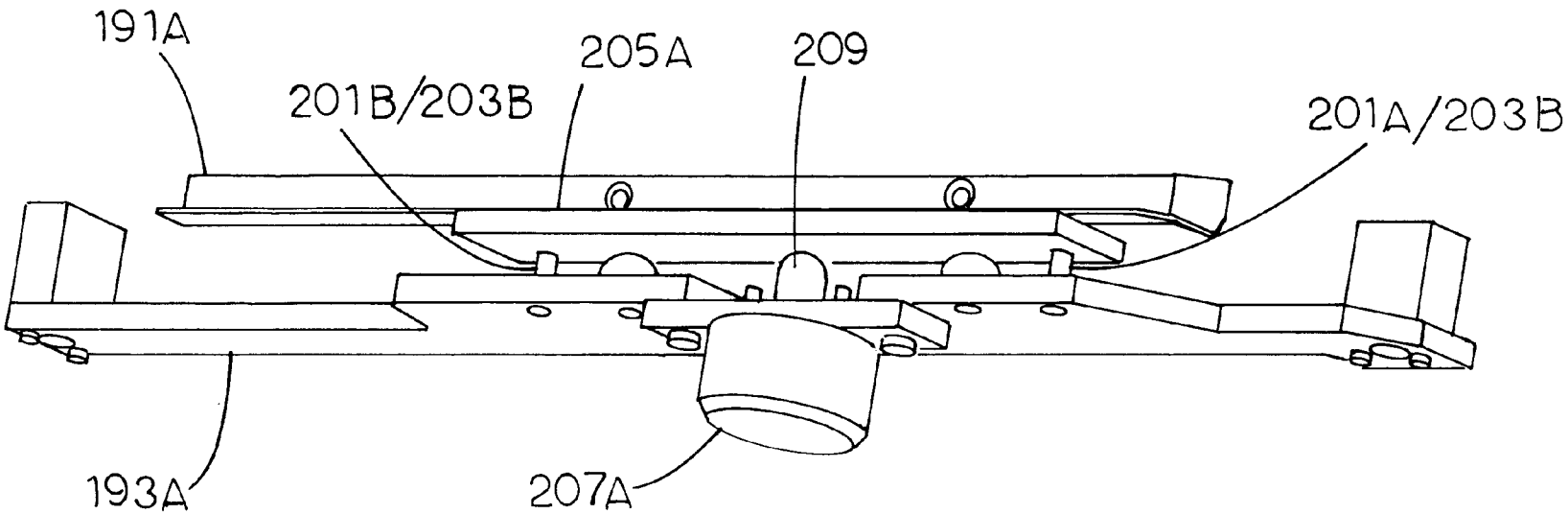
FIG. 15 is a perspective view of the portion of the side-to-side jogging assembly illustrated in FIG. 14.

FIGS. 13–15 illustrate details of the side jogging mechanism provided in accumulating apparatus 10. The side jogging mechanism includes two adjustable side guides 191A and 191B generally situated in accumulation area 20. Side guides 191A and 191B function to guide sheets into and through accumulation area 20, as well as to laterally jog the sheets as they accumulate (or after a predetermined number of sheets have accumulated) in order to register the side edges of the sheet stack. The respective lateral positions of side guides 191A and 191B are adjustable with respect to the longitudinal centerline of accumulation area 20—that is, the centerline in the direction of material flow. Accordingly, as shown in FIG. 13, each side guide 191A and 191B is connected to a respective adjustable mounting bracket 193A and 193B. In addition, the upstream ends of each adjustable mounting bracket 193A and 193B are slidingly supported by a transversely disposed support rod 195, and the downstream ends of each adjustable mounting bracket 193A and 193B are slidingly supported by another transversely disposed support rod 197. The width between side guides 191A and 191B can thus be varied to accommodate different sheet sizes (e.g., a range of approximately 5.50 inches to approximately 12.0 inches) by sliding adjustable mounting brackets 193A and 193B toward or away from each other along threaded support rods 195 and 197. The adjustment could be manual or mechanized in accordance with known methods. Preferably, side guides 191A and 191B are initially positioned equidistantly about the center line of accumulation area 20, and the width between side guides 191A and 191B, for example, is approximately 0.25 inches greater than the actual width of the sheets to be processed to allow room for side-to-side jogging.

As shown in FIGS. 14 and 15, each side guide 191A and 191B is connected to its respective adjustable mounting bracket 193A and 193B by one or more suitable linking members such as bolts 201A and 201B. Preferably, as shown in FIG. 15, two or more spaced bolts 201A and 201B are employed to improve the stability of side guides 191A and 191B. As also shown in FIGS. 14 and 15, each side guide 191A and 191B is biased laterally outwardly from the centerline of accumulation area 20 by springs 203A and 203B. As shown in FIG. 14, each spring 203A and 203B is retained on its corresponding bolt 201A and 201B between the head of bolt 201A and 201B and a back plate 205A and 205B of its corresponding side guide 191A and 191B.

The jogging movement is effected by a suitable actuator such as a solenoid 207A and 207B mounted to each adjustable mounting bracket 193A and 193B. The moving portion of each solenoid 207A and 207B, for example an actuating arm 209, is able to contact back plate 205A and 205B of each corresponding side guide 191A and 191B. Hence, activation of each solenoid 207A and 207B causes extension of its actuating arm 209, and in turn causes its side guide 191A and 191B to translate inwardly toward the centerline of accumulation area 20 against the biasing force of springs 203A and 203B. Deactivation of each solenoid 207A and 207B causes its side guide 191A and 191B to return to its initial position under the influence of springs 203A and 203B. Alternate activation and deactivation of solenoids 207A and 207B produces the jogging action that results in side-to-side registration of sheets in accumulation area 20. The sheet stack can be jogged each time a new sheet is added to the stack, or can be jogged after the predetermined number of sheets have been added to complete the stack. Preferably, the amount by which each solenoid 207A and 207B causes extension of its respective actuating arm 209 depends on the initial width set between side guides 191A and 191B. For example, if the initial width is set to approximately ¼ inches greater than the actual width of the sheets being processed, the distance by which each actuating arm 209 extends can be ⅛ inches The operation of accumulating apparatus 10 when positioned in its over-accumulation mode will now be described with reference to FIG. 4. A stack S of over-accumulated sheets is shown disposed between upper and lower support rods 45 and 47, resting on bottom support rods 47 and supported (i.e., retained or held down) by top hold-down fingers 63. The leading edge of the sheet stack is registered against front stop fingers 113 of front stop mechanism 110, while the trailing edge of the sheet stack is registered against the respective back surfaces of the bottom accumulation ramps 61. As described hereinabove, the jogging action generated by the recoil of front stop fingers 113 as each sheet reaches sheet stack S assists in obtaining this front-to-back registration of all sheets of sheet stack S. An incoming sheet IS is shown being fed through input section 15 to be accumulated over existing sheet stack S. Top accumulation ramps 59 are in a raised position out of the material feed plane, and thus out of the way of incoming sheet IS. Similarly, bottom hold-down fingers 65 are in a lowered position out of the material feed plane, and thus out of the way of incoming sheet IS. Bottom accumulation ramps 61 are in a raised position in the material feed plane, such that the leading edge of incoming sheet IS encounters their respective inclined front surfaces and is thereby raised above the top side of the uppermost sheet in the accumulating stack S. Top hold-down fingers 63 are in a lowered position in the material feed plane. Each incoming sheet IS flows over bottom accumulation ramps 61, is guided downwardly by top hold-down fingers 63, is jogged by recoiling front stop fingers 113, and comes to rest on the top of stack S in registry between front stop fingers 113 and bottom accumulation ramps 61.

The operation of accumulating apparatus 10 when positioned in its under-accumulation mode will now be described with reference to FIG. 5. Stack S of under-accumulated sheets, or at least the trailing end region thereof, is held against top support rods 45 by bottom hold-down fingers 65. The leading edge of sheet stack S is registered against front stop fingers 113 of front stop mechanism 110, while the trailing edge of sheet stack S is registered against the respective back surfaces of top accumulation ramps 59. Top accumulation ramps 59 are in a lowered position in the material feed plane, such that the leading edge of incoming sheet IS encounters their respective inclined front surfaces and is thereby directed downwardly underneath the bottom side of the bottommost sheet in accumulating stack S. Bottom hold-down fingers 65 are in a raised position in the material feed plane, and thus support sheet stack S in a raised position and guide incoming sheets IS upwardly to allow incoming sheets IS to accumulate underneath sheet stack S. Bottom accumulation ramps 61 are in a lowered position out of the way of the incoming sheets IS. Similarly, top hold-down fingers 63 are in a raised position out of the material feed plane, and thus out of the way of incoming sheets IS and accumulating stack S. Each incoming sheet IS flows along the inclined front surfaces of top accumulation ramps 59 and between stack S and bottom hold-down fingers 65, is jogged by recoiling front stop fingers 113, and comes to rest at the bottom of stack S in registry between front stop fingers 113 and top accumulation ramps 59.

Referring now to FIG. 16, according to an aspect of the invention, it can be seen that upper section 10A of accumulating apparatus 10 includes an upper frame 220 that is hinged or otherwise rotatably attached to lateral support plates 30A and 30B of lower section 10B about pivot points 223A and 223B (e.g., pins or axles with appropriate mounting hardware). As shown in FIGS. 2 and 4, upper section 10A comprises top entrance guide 51A, top accumulation ramp 59, top hold-down finger 63, first top gear segment 55A, second top gear segment 55B, and top support rods 45. Through their supportive association with upper section 10A of accumulating apparatus 10, all of these components pivot away from accumulation area 20 as one assembly, thereby facilitating access into accumulation area 20 to enable removal of sheets without damage thereto.

Although not specifically shown in the drawings, it will be understood that an appropriately programmed electronic controller such as a microprocessor, or other conventional means for executing instructions and receiving and/or sending signals, is placed in communication with the variable speed motor driving dynamic infeed rollers 53A and 53B, the motor driving transport belts 81A and 81B, the actuator 131 driving front stop fingers 113, the motor 161 driving output rollers 141A and 141B, the motor driving exit rollers 181A and 181B, and the solenoids 207A and 207B driving the side guides 191A and 191B. The electronic controller can thus maintain synchronization of these various components of accumulating apparatus 10, as well as control the respective operations of specific components. It will be further understood that the electronic controller can receive feedback from upstream and downstream devices in order to determine the proper speeds of the various rollers, and can receive feedback from various sensors situated in accumulating apparatus 10 to determine the location of sheets or to count the number of sheets accumulating in accumulation area 20. Thus, the electronic controller determines the dynamic speed profile of dynamic infeed rollers 53A and 53B, as described hereinabove, in order to feed sheets at an initial input speed and slow the sheets down to a reduced registration speed as the sheets approach front stop fingers 113. In addition, the electronic controller determines the proper time to side jog the sheet stack as sheets enter accumulation area 20. Moreover, the electronic controller determines when the proper number of sheets have accumulated, after which time the electronic controller causes front stop fingers 113 to retract out of the material flow path, transport belts 81A and 81B to move the stack forward into output rollers 141A and 141B, output rollers 141A and 141B to move the stack to exit rollers 181A and 181B, and the exit rollers 181A and 181B to move the stack toward an area or device downstream from accumulating apparatus 10. The provision of independent input, transport, and output drives enables accumulating apparatus 10 to be matched with any upstream and downstream devices.

In one specific but non-limiting embodiment, accumulating apparatus 10 supports sheets that are 5.50 inches (140 mm) to 12.00 inches (305 mm) wide and 3.50 inches (89 mm) to 14.00 inches (356 mm) long. This accumulating apparatus 10 can accumulate 1 to 30 sheets of 18-lb. to 24-lb. paper. Conversion time related to material size and over/under accumulation mode switching is approximately two minutes or less. In addition, this accumulating apparatus 10 can accommodate material skew from 0.5 degrees to 2 degrees, depending on sheet length. Sheets are registered from lead-to-trail edge and side-to-side within a 0.008-inches (0.20-mm) offset.

The operation of accumulating apparatus 10 as described hereinabove will now be summarized with reference being made primarily to FIGS. 4, 5 and 8. As an incoming sheet IS enters accumulating apparatus 10 under the control of an upstream device, incoming sheet IS passes through top and bottom entrance guides 51A and 51B into the nip formed by top and bottom infeed rollers 53A and 53B. Incoming sheet IS thus enters accumulation area 20 under the control of dynamic in-feed rollers 53A and 53B. At this point, the rotational speed of dynamic in-feed rollers 53A and 53B is preferably matched to the output speed of the upstream device. Preferably, this matched speed is at or near the maximum speed of dynamic in-feed rollers 53A and 53B, and thus corresponds to the maximum flow rate of incoming sheets IS into input section 15 of accumulating apparatus 10. Dynamic in-feed rollers 53A and 53B advance incoming sheet IS into accumulating apparatus 10 for a predetermined distance, at the top speed that is preferably matched to the output speed of the upstream material processing device. The speed of in-feed rollers 53A and 53B is then dynamically reduced to dynamically slow down the flow rate of incoming sheet IS, thereby allowing the lead edge of incoming sheet IS to contact spring-loaded front stop mechanism 110 without the risk of damage.

The recoiling reaction of front stop mechanism 110 induces a jogging action that registers incoming sheet IS with the rest of sheet stack S between front stop mechanism 110 and either top accumulation ramp 59 or bottom accumulation ramp 61 (depending on whether accumulating apparatus 10 is set for under-accumulation or over-accumulation as described hereinabove). Dynamic in-feed rollers 53A and 53B increase speed back up to top velocity to advance subsequent incoming sheets IS into accumulation area 20, and the slowdown process again occurs such that the dynamic speed profile is implemented for each cycle of incoming sheets IS being fed into accumulating apparatus 10. Each incoming sheet IS can be fed completely individually, in subsets, or in overlapping relation to other incoming sheets IS.

When a complete set of sheets (sheet stack S) has been over- or under-accumulated, the following exit routine transpires. Spring loaded front stop fingers 113 retract out of the sheet feed path. Side guides 191A and 191B (see FIGS. 13–15) contact the sides of the sheet set and register the sheets from side-to-side in the manner described hereinabove. Side guides 191A and 191B hold the sheet set in a registered position for a predetermined time of the exit routine and then release the sheet set. Dual-lugged transport belts 81A and 81B start to cycle. In one example, one cycle equals 180 degrees at a fixed speed of approximately 30 ips. The low speed of dual-lugged transport belts 81A and 81B minimizes trail-edge damage when outside lugs contact 93 (see FIG. 6) and advance the set of accumulated sheets. As dual-lugged transport belts 81A and 81B cycle, they contact the trail edge of the set of accumulated sheets and advance the lead edge of the accumulated set into the pair of output rollers 141A and 141B. As described hereinabove, output rollers 141A and 141B are positioned at a fixed distance downstream from front stop fingers 113, and their speed is preferably matched with that of the downstream device, which ordinarily will be a fixed, constant speed ranging between, e.g., approximately 80 ips to approximately 180 ips. As the lead edge of sheet stack S enters output rollers 141A and 141B, output rollers 141A and 141B advance sheet stack S at a higher rate of speed than dual-lugged transport belts 81A and 81B. As sheet stack S advances in this manner, its lead edge enters the pair of fixed-position exit rollers 181A and 181B, the speed of which is preferably matched with the speed of output rollers 141A and 141B and that of the downstream device. Once the trail edge of this sheet stack S has passed by spring-loaded front stop fingers 113, front stop fingers 113 extend back into the sheet path ready for the next set of sheets to accumulate.

It can be seen from the foregoing that no moving components of accumulating apparatus 10 contact the sheet material during accumulation thereof. Thus, the risk of toner smudging/transfer to the sheet material is significantly reduced or even eliminated. Moreover, the adjustments to accumulating apparatus 10 required to effect a change-over between under-accumulation and over-accumulation, and to effect a change in material size, is quick, easy, and tool-less.

It will be understood that various details of the invention may be changed without departing from the scope of the invention. Furthermore, the foregoing description is for the purpose of illustration only, and not for the purpose of limitation—the invention being defined by the claims.

What is claimed is:

1. A sheet accumulating apparatus comprising:

(a) an accumulation section defining a sheet feed plane therethrough;

(b) an upper ramp disposed upstream from the accumulation section and movable into and out of the sheet feed plane;

(c) an upper retaining member linked to the upper ramp and movable into and out of the sheet feed plane in alternating relation to the upper ramp;

(d) a lower ramp disposed below the upper ramp and movable into and out of the sheet feed plane in alternating relation to the upper ramp; and (e) a lower retaining member linked to the lower ramp and movable into and out of the sheet feed plane in alternating relation to the upper ramp.

2. The apparatus according to claim 1 wherein the accumulation section comprises a plurality of upper elongate members and a plurality of lower elongate members, and the sheet feed plane is defined between the upper and lower elongate members.

3. The apparatus according to claim 1 wherein the upper ramp, the upper retaining member, the lower ramp, and the lower retaining member are pivotably movable into and out of the sheet feed plane, the upper ramp is pivotable in an opposite direction in relation to the pivoting of the upper retaining member, and the lower ramp is pivotable in an opposite direction in relation to the pivoting of the lower retaining member.

4. The apparatus according to claim 3 comprising an upper linkage linking the upper ramp to the upper retaining member and a lower linkage linking the lower ramp to the lower retaining member, wherein the upper linkage comprises a first upper linkage member pivotable with the upper ramp and a second upper linkage member pivotable with the upper retaining member in engagement with the first upper linkage member, and the lower linkage comprises a first lower linkage member pivotable with the lower ramp and a second lower linkage member pivotable with the lower retaining member in engagement with the first lower linkage member.

5. The apparatus according to claim 4 wherein the first and second upper linkage members include respective toothed portions disposed in meshing engagement with each other, and the first and second lower linkage members include respective toothed portions disposed in meshing engagement with each other.

6. The apparatus according to claim 1 comprising a front stop mechanism disposed downstream from the upper and lower ramps and movable into and out of the sheet feed plane.

7. The apparatus according to claim 6 comprising a frame and a carriage assembly, the carriage assembly movably engaged with the frame and supporting the front stop mechanism, wherein the front stop mechanism is movable with the carriage assembly toward and away from the upper and lower ramps.

8. The apparatus according to claim 1 comprising a sheet transport device comprising a sheet-engaging member, wherein the sheet-engaging member is movable through the accumulation section along the sheet feed plane.

9. The apparatus according to claim 1 comprising left and right side jogging members disposed at respective lateral sides of the accumulation section, wherein the left and right side jogging members are movable toward and away from each other along a direction transverse to a sheet flow path through the accumulation section.

10. A sheet accumulating apparatus comprising:

(a) an accumulation section defining a sheet feed plane therethrough; and (b) an accumulating input assembly disposed upstream from the accumulation section and selectively adjustable to an over-accumulation position and an alternative under-accumulation position, the accumulating input assembly comprising:

(i) a movable first ramp, a movable first retaining member, and a first linkage interconnecting the first ramp and the first retaining member; and (ii) a movable second ramp, a movable second retaining member, and a second linkage interconnecting the second ramp and the second retaining member;

(c) wherein, at the over-accumulation position, the first ramp and the second retaining member are disposed out of the sheet feed plane and the second ramp and the first retaining member extend in the sheet feed plane and, at the alternative under-accumulation position, the first ramp and the second retaining member extend in the sheet feed plane and the second ramp and the first retaining member are disposed out of the sheet feed plane.

11. The apparatus according to claim 10 wherein the accumulation section comprises a plurality of upper elongate members and a plurality of lower elongate members, and the sheet feed plane is defined between the upper and lower elongate members.

12. The apparatus according to claim 10 wherein the first ramp, the first retaining member, the second ramp, and the second retaining member are pivotably movable into and out of the sheet feed plane, the first ramp is pivotable in an opposite direction in relation to the pivoting of the first retaining member, and the second ramp is pivotable in an opposite direction in relation to the pivoting of the second retaining member.

13. The apparatus according to claim 10 wherein the first linkage comprises a first upper linkage member pivotable with the first ramp and a second upper linkage member pivotable with the first retaining member in engagement with the first upper linkage member, and the second linkage comprises a first lower linkage member pivotable with the second ramp and a second lower linkage member pivotable with the second retaining member in engagement with the first lower linkage member.

14. A sheet accumulating apparatus comprising:

(a) an upper frame section having an upper input end and a lower frame section having a lower input end, wherein the upper and lower input ends define an input area and a sheet feed plane therebetween, and the sheet feed plane extends through the input area;

(b) a first upper rotatable member disposed in the upper frame section and a second upper rotatable member engaging the first upper rotatable member, wherein rotation of the first upper rotatable member in one direction corresponds to rotation of the second upper rotatable member in an opposite direction;

(c) an upper accumulation ramp connected to the first upper rotatable member and rotatable therewith into and out of the sheet feed plane;

(d) an upper sheet guide member connected to the second upper rotatable member and rotatable therewith out of and into the sheet feed plane;

(e) a first lower rotatable member disposed in the lower frame section and a second lower rotatable member engaging the first lower rotatable member, wherein rotation of the first lower rotatable member in one direction corresponds to rotation of the second lower rotatable member in an opposite direction;

(f) a lower accumulation ramp connected to the first lower rotatable member and rotatable therewith into and out of the sheet feed plane; and (g) a lower sheet guide member connected to the second lower rotatable member and rotatable therewith out of and into the sheet feed plane.

15. The apparatus according to claim 14 wherein the sheet feed plane extends through the input area along a sheet feed direction, the first upper rotatable member comprises at least two first upper rotatable member portions, the second upper rotatable member comprises at least two second upper rotatable member portions, the first lower rotatable member comprises at least two first lower rotatable member portions, and the second lower rotatable member comprises at least two second lower rotatable member portions, the apparatus comprising:

(a) an upper mounting member disposed transversely in relation to the sheet feed direction and interconnecting the at least two first upper rotatable member portions, wherein the upper accumulation ramp is mounted to the upper mounting member; and (b) a lower mounting member disposed transversely in relation to the sheet feed direction and interconnecting the at least two first lower rotatable member portions, wherein the lower accumulation ramp is mounted to the lower mounting member.

16. A sheet accumulating apparatus comprising:

(a) an upper frame section having an upper end and a lower frame section having a lower end, the upper and lower frame sections defining an accumulation area therebetween, wherein the upper end pivotably engages the lower end to enable the upper section to pivot away from the lower section to provide access to the accumulation area;

(b) a plurality of elongate upper sheet guides supported by the upper frame section and pivotable therewith, the upper sheet guides defining an upper boundary of the accumulation area;

(c) a plurality of elongate lower sheet guides supported by the lower frame section, the lower sheet guides defining a lower boundary of the accumulation area;

(d) an upper accumulation selection ramp supported by the upper frame section and pivotable therewith; and (e) a lower accumulation selection ramp supported by the lower frame section.

17. A material accumulating apparatus comprising:

(a) a frame assembly comprising first and second lateral support plates;

(b) an input section disposed at an upstream region of the frame assembly and defining a material flow path running between the first and second lateral support plates;

(c) a carriage assembly comprising a front stop support plate extending between the first and second lateral support plates, a first carriage member movably connecting the front stop support plate to the first lateral support plate, and a second carriage member movably connecting the front stop support plate to the second lateral support plate whereby the front stop support plate is movable between the first and second lateral support plates by movement of the first and second carriage members along the first and second lateral support plates, respectively; and (d) a front stop mechanism disposed downstream from the input section and mounted to the front stop support plate, and at least one roller mounted to the front stop support plate downstream from the front stop mechanism, wherein translation of the front stop support plate along a general direction of the material flow path varies a distance between the front stop mechanism and the input section.

18. The apparatus according to claim 17 wherein the front stop mechanism comprises a front stop member and an actuator connected to the front stop member, wherein the front stop member is movable by the actuator into and out of the material flow path.

19. The apparatus according to claim 18 wherein the front stop member is spring-mounted.

20. A material accumulating apparatus comprising:

(a) a sheet input device comprising a first input roller and a second input roller, wherein a material feed plane is defined between the first and second input rollers;

(b) an accumulation area disposed generally downstream from the sheet input device, the accumulation area comprising a plurality of upper guide rods and a plurality of lower guide rods, wherein the material feed plane is disposed between the upper and lower guide rods;

(c) a front stop mechanism disposed downstream from the sheet input device, the front stop mechanism comprising a front stop member and an actuator connected to the front stop member, wherein the front stop member is movable by the actuator into and out of the material feed plane;

(d) first and second output rollers disposed at a fixed distance downstream from the front stop mechanism; and (e) a material transport device comprising movable material-engaging lugs between the first and second input rollers and the first and second output rollers.

21. A material accumulating apparatus comprising:

(a) a frame assembly comprising first and second lateral support plates;

(b) an input section disposed at an upstream region of the frame assembly and defining a material flow path running between the first and second lateral support plates;

(c) a side jogging mechanism disposed downstream from the input section and comprising:

(i) an upstream support rod extending between the first and second lateral support plates;

(ii) a downstream support rod extending between the first and second lateral support plates;

(iii) first and second mounting brackets, each mounting bracket having an upstream end slidably supported by the upstream support rod and a downstream end slidably supported by the downstream support rod;

(iv) first and second side guides respectively linked to the first and second mounting brackets; and (v) first and second actuating devices respectively adapted to translate the first and second side guides along a direction transverse to the material flow path; and (d) a front stop mechanism disposed downstream from the input section and mounted to the front stop support plate, wherein translation of the front stop support plate along a general direction of the material flow path varies a distance between the front stop mechanism and the input section.

22. A material accumulating apparatus comprising:

(a) a frame assembly comprising first and second lateral support plates;

(b) an input section disposed at an upstream region of the frame assembly and defining a material flow path running between the first and second lateral support plates;

(c) a carriage assembly comprising a front stop support plate extending between the first and second lateral support plates, a first carriage member movably connecting the front stop support plate to the first lateral support plate, and a second carriage member movably connecting the front stop support plate to the second lateral support plate;

(d) a front stop mechanism disposed downstream from the input section and mounted to the front stop support plate, wherein translation of the front stop support plate along a general direction of the material flow path varies a distance between the front stop mechanism and the input section; and (e) a first rack gear mounted to the first lateral support plate, a second rack gear mounted to the second lateral support plate, a first pinion gear fixedly disposed in relation to the first carriage member and engaging the first rack gear, and a second pinion gear fixedly disposed in relation to the second carriage member and engaging the second rack gear, wherein rotation of the first and second pinion gears respectively along the first and second rack gears causes translation of the first and second carriage members respectively along the first and second rack gears.

23. A material accumulating apparatus comprising:

(a) a frame assembly comprising first and second lateral support plates;

(b) an input section disposed at an upstream region of the frame assembly and defining a material flow path running between the first and second lateral support plates;

(c) a carriage assembly comprising a front stop support plate extending between the first and second lateral support plates, a first carriage member movably connecting the front stop support plate to the first lateral support plate, and a second carriage member movably connecting the front stop support plate to the second lateral support plate;

(d) a front stop mechanism disposed downstream from the input section and mounted to the front stop support plate, wherein translation of the front stop support plate along a general direction of the material flow path varies a distance between the front stop mechanism and the input section; and (e) an upper output roller and a lower output roller, the upper and lower output rollers fixedly mounted in relation to the front stop mechanism and translatable therewith.

24. A material accumulating apparatus comprising:

(a) a frame assembly comprising at least first and second lateral support plates for accumulating material in an accumulation area between the first and second lateral support plates;

(b) an input section disposed at an upstream region of the frame assembly and defining a material flow path running between the first and second lateral support plates;

(c) a front stop mechanism disposed downstream from the input section and being selectively movable into and out of the sheet feed path;

(d) at least one roller fixedly positioned with respect to the front stop mechanism and downstream from the front stop mechanism for selectively advancing material accumulated in the accumulation area; and (e) the front stop mechanism and the at least one roller being simultaneously movable in fixed relation to one another along the sheet feed plane for adjusting a size of the accumulation area.

* * * * *